US011905835B1

(12) United States Patent
Khorshidi

(10) Patent No.: US 11,905,835 B1
(45) Date of Patent: Feb. 20, 2024

(54) TUNNEL DIGGING MACHINE (TDM)

(71) Applicant: TopEng Inc., Oakville (CA)

(72) Inventor: Behzad Khorshidi, Oakville (CA)

( * ) Notice: Subject to any disclaimer, the term of this patent is extended or adjusted under 35 U.S.C. 154(b) by 91 days.

(21) Appl. No.: 17/476,399

(22) Filed: Sep. 15, 2021

Related U.S. Application Data

(60) Provisional application No. 63/079,995, filed on Sep. 17, 2020.

(51) Int. Cl.

| | |
|---|---|
| ***E21D 9/087*** | (2006.01) |
| ***E21D 9/06*** | (2006.01) |
| ***E21D 11/38*** | (2006.01) |
| ***E21D 9/08*** | (2006.01) |
| *E21D 9/12* | (2006.01) |

(52) U.S. Cl.
CPC ..... *E21D 9/0879* (2016.01); *E21D 9/0621* (2013.01); *E21D 11/385* (2013.01); *E21D 9/12* (2013.01)

(58) Field of Classification Search
CPC ..... E21D 9/08; E21D 9/087; E21D 9/0879; E21D 9/0621; E21D 9/0692; E21D 9/12; E21D 9/124; E21D 11/385
USPC ..... 405/141
See application file for complete search history.

(56) References Cited

U.S. PATENT DOCUMENTS

| | | | | |
|---|---|---|---|---|
| 3,731,977 A * | 5/1973 | Benedek | E21D 9/08 | 405/138 |
| 5,284,403 A * | 2/1994 | Ilomaki | E21D 9/108 | 405/141 |
| 6,206,478 B1 * | 3/2001 | Uehara | E21C 27/24 | 299/59 |
| 7,040,712 B2 * | 5/2006 | Sakae | E21D 9/0879 | 405/141 |
| 7,475,947 B2 * | 1/2009 | LeBegue | E21D 9/117 | 299/80.1 |

FOREIGN PATENT DOCUMENTS

| | | | | |
|---|---|---|---|---|
| AU | 2018311427 A1 * | 3/2020 | E21D 20/003 | |
| CN | 104533435 A * | 4/2015 | E21D 9/0621 | |
| CN | 105781561 A * | 7/2016 | E21D 20/003 | |
| CN | 109209413 A * | 1/2019 | E21D 9/087 | |
| RU | 2552539 C1 * | 6/2015 | E21D 9/06 | |
| RU | 2703027 C1 * | 10/2019 | | |

* cited by examiner

*Primary Examiner* — Frederick L Lagman

(57) ABSTRACT

A Tunnel Digging Machine (TDM) is a shield machine to excavate tunnels with almost any desired cross sections including rectangular, square, sub/semi-rectangular, sub/semi-square, horseshoe/U-shaped, elliptical, circular, sub/semi circular and such sections through a variety of soil and rock strata. The TDM can be designed to dig through anything from hard rock to sand with large range of width and height configurations. The TDMs can limit the disturbance to the surrounding ground and produce a tunnel lining. The TDMs may be used as an alternative to the current conventional Tunnel Boring Machines (TBM) or continuous miners. The major advantage of the TDMs over the TBMs will be their higher speed (higher advancement rate), fully sealable face, flexibility in the desired cross-section and reduced construction costs due to the mentioned higher speed, efficiency and optimized cross-section.

12 Claims, 24 Drawing Sheets

25.46 / 34.73= 73.3%
26.7 % LESS EXCAVATION BY OPTIMIZED SECTION IN TDM '

TUNNEL DIGGING MACHINE (TDM)

FIELD OF THE INVENTION

This invention is generally related to introduction and basics of a new shield machine to excavate and provide lining and can be used widely in tunnelling industry and its variations.

BACKGROUND AND SUMMARY OF THE INVENTION

A Tunnel Digging Machine (TDM) is a shield machine to excavate tunnels with almost any desired cross sections including rectangular, square, sub/semi-rectangular, sub/semi-square, horseshoe/U-shaped, elliptical, circular, sub/semi circular and such sections through a variety of soils and rock strata. The TDM can be designed to dig through anything from hard rock to sand with large range of width and height configurations. The TDMs can limit the disturbance to the surrounding ground and produce a tunnel lining.

The TDMs may be used as an alternative to the current conventional Tunnel Boring Machines (TBM) or continuous miners. The major advantage of the TDMs over the TBMs will be their higher speed (higher advancement rate), fully sealable face, flexibility in the desired cross-section and reduced construction costs due to the mentioned higher speed, efficiency and optimized cross-section.

DETAILED DESCRIPTION

Figure 1:
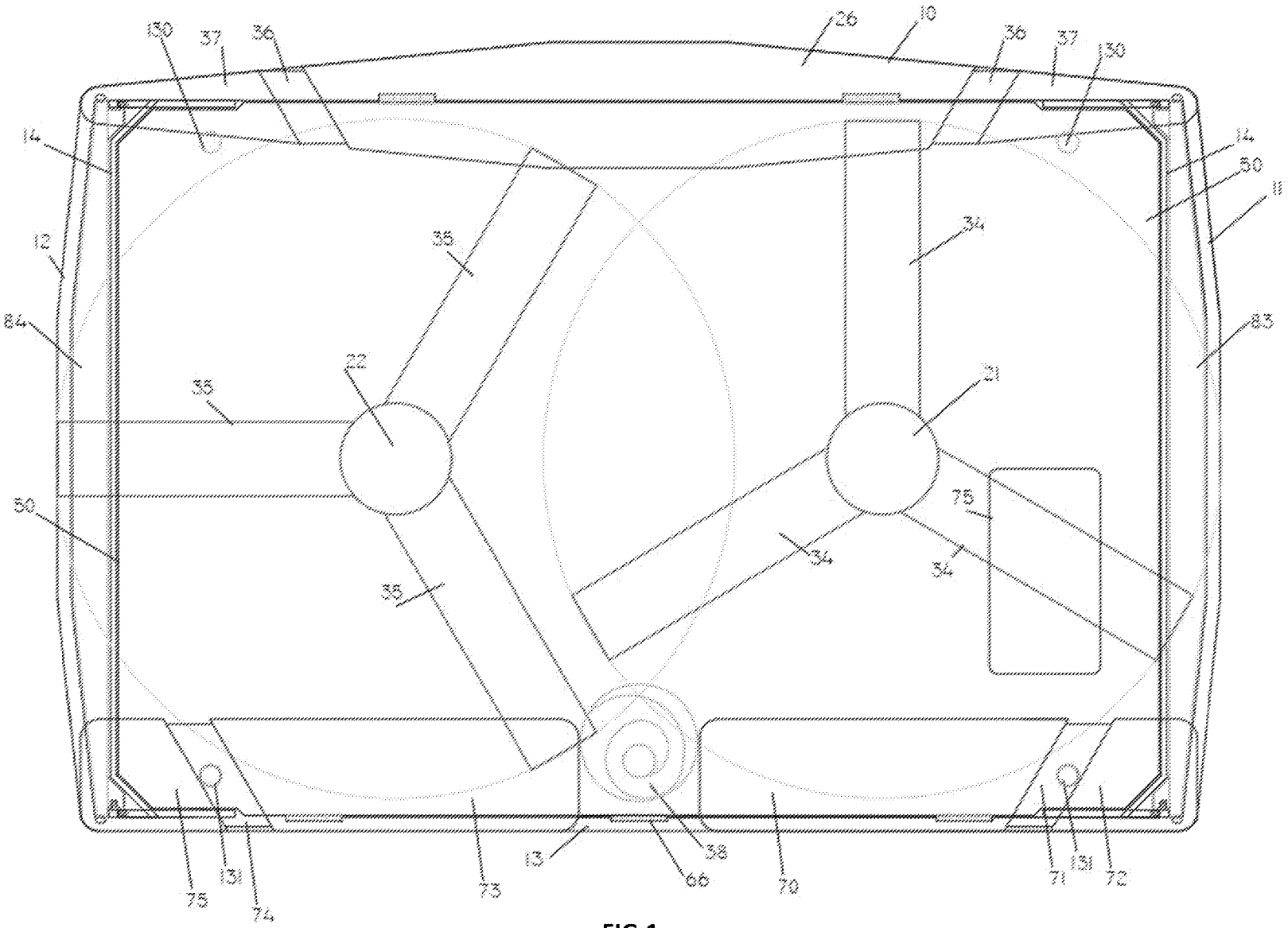
FIG. 1. Front view of TDM at digging mode
Figure 2:
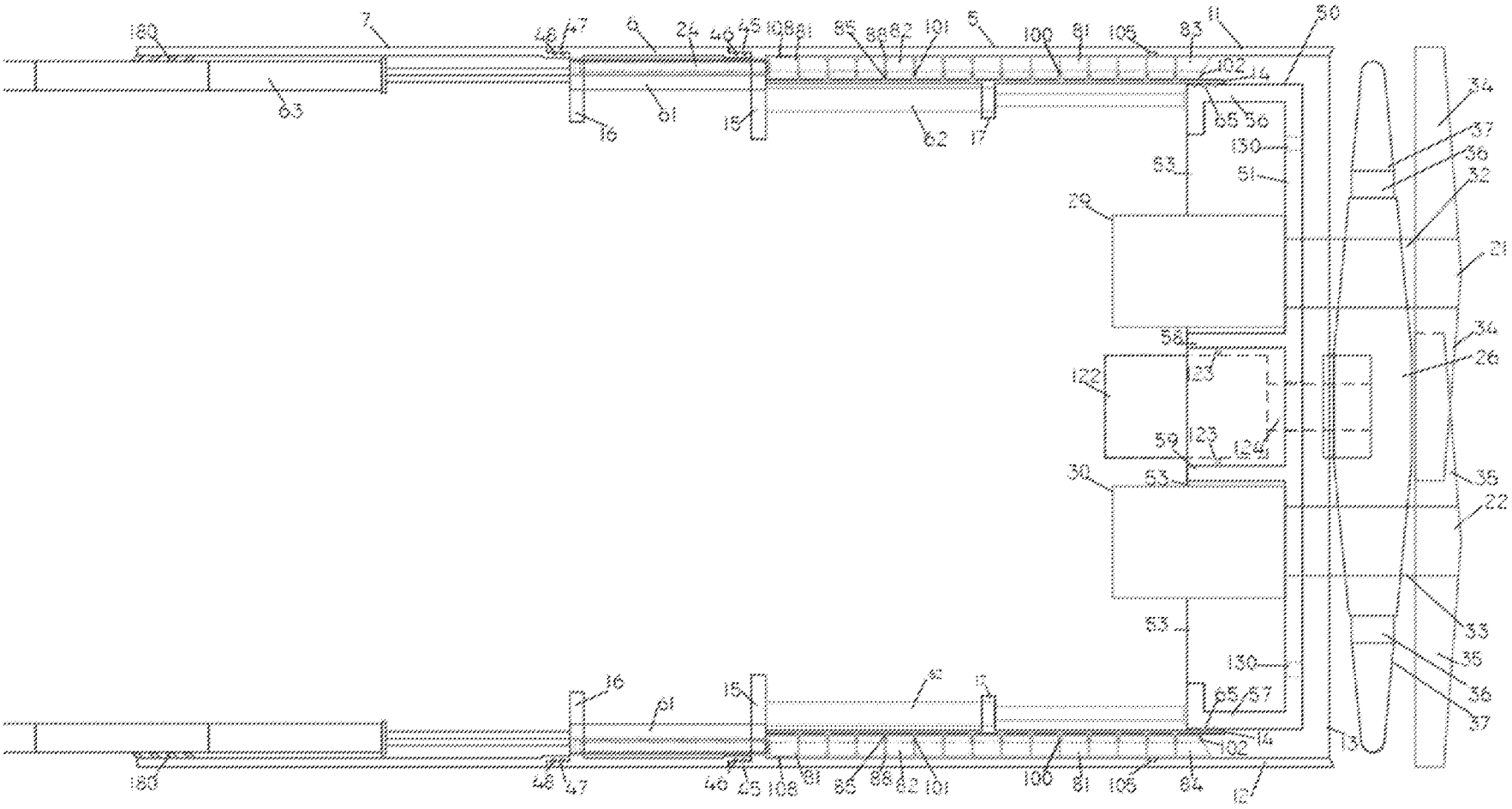
FIG. 2. Plan view of TDM at digging mode (Section thru middle—Looking Up)

Advantages, objects and novel features of this invention will become apparent from the following detailed description when considered along with the accompanying drawings. One skilled in the art understand that other embodiments may be utilized, and other structural, mechanical, electrical and logical changes may be made without departing from the scope of the present invention. So, the following detailed illustration to not be taken in limiting sense as scope of the present invention are defined in the relevant claims. A sample of a basic TDM concept for a sub-rectangular lining (semi U-shape/horseshoe) is being explained in further details at this document in order to address the main concept of the TDM at its digging and sealing modes. Obviously the TDM and its all elements may have many variations.

Digging Mode

FIGS. 1, 2, 3 and 4 are showing a TDM sample (e.g. 4 m×6 m) at digging stage. A plurality of cutter rotors, cutter drums and chain cutters may be used in a TDM to suit with the cross section of the tunnel. At this example, the rotor #1 (21) and rotor #2 (22), upper cutter drum 26, lower cutter drum #1 (70) and lower cutter drum #2 (70) are used as main cutting tools.

The rotor #1 (21) and rotor #2 (22) are consisting plurality (3 at this example) of cutting blades 34 and 35 (cutting bits/discs are not shown for more clarity) and upper drum 26 is consisting of telescopic extensions 36 and expandable parts 37 at both ends. Similarly the lower cutting drum #1 (70) and drum #2 (73) are consisting of telescopic extension 71 and 74 and expandable ends 72 and 75 (Bits/discs are not shown for more clarity).

A mucking screw conveyor 28 and its helical extension 38 is located at middle bottom portion of the TDM face for discharging of the excavated material and transferring them to two conveyor belts 41 and 42 via foldable shoots/ramps 39 and 40.

The rotors 21 and 22 and drums 26, 70 and 73 and screw conveyor 28 are all mounted on a strong mobile frame 50 which is able to move back and forth by its thrust cylinder 62. The thrust cylinders 62 are located between internal frame 15 and 17.

The mobile frame 50 is a structure consisting of horizontal and vertical walls including front part of 51, upper part of 52, horizontal inner upper part 53, horizontal inner lower part 54, lower part 55, Side—near Rotor #1 (56), Side—near Rotor #2 (57), Vertical inner part—near Rotor #1 (58), Vertical inner part—near Rotor #2 (59).

Figure 23:
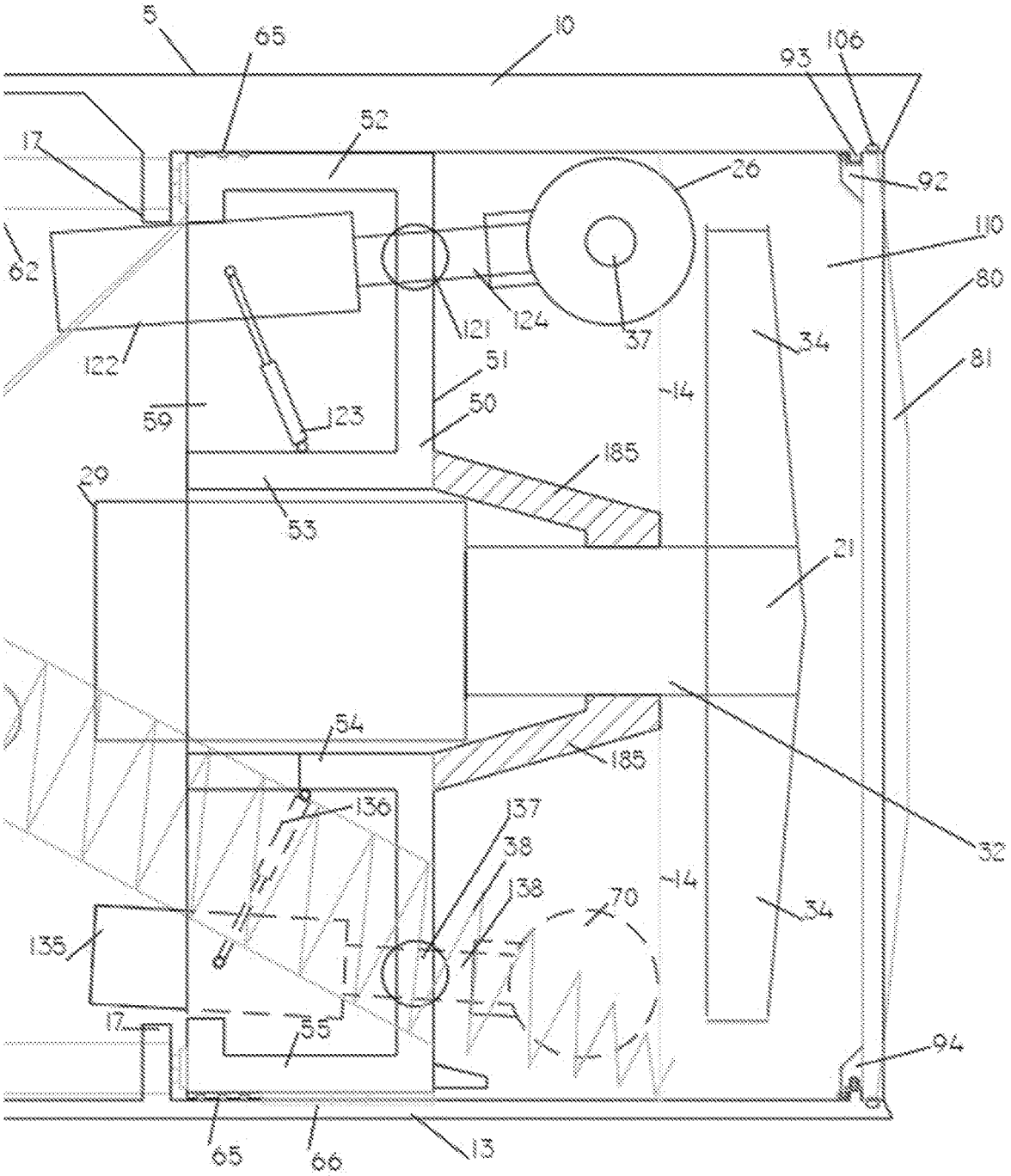

Since rotors 21 and 22 would need relatively long shafts 32 and 33, extra supports e.g. cone shape supports 182 may be added on the mobile frame 50. (See FIG. 23)

At rear perimeter of the mobile frame 50, sealing gaskets 65 are mounted at their grooves for waterproofing between front and rear of the mobile frame 50. The sealing gaskets 65 are continuous gaskets all around the mobile frame 50 perimeter and are in contact with TDM's upper side 10 and lower side 13 and internal skin walls 14.

To ease the movement of the mobile frame 50 within the forward shield 5 of the TDM, bottom rollers 66 are mounted under lower part 55 and also upper rollers 67 are mounted above the upper part 52 of the mobile frame 50. The rollers 66 and 67 will be moved on their grooves (trenches) made on the bottom side 13 and upper side 10 of the TDM. The upper rollers 67 may be optional however they would help in overall smooth movement of the mobile frame 50. (See FIG. 6).

The mucking screw conveyor 28 is mounted directly on the front face 51 of the mobile frame 50 at its front and also hung by extra supports 140 (e.g. wirerope, rods, etc.) to upper part of the mobile frame 50.

Sidenote: At this example there is only one screw conveyor 28. If necessary, placing more screw conveyors can be possible in a TDM. For example, assuming front face of TDM as a map, south-west and south-east of the face may be considered to add screw conveyors. Also if soil condition allows other types of conveyors (e.g. belt/chain conveyor) may be used instead of the screw conveyor 28.

The upper cutter drum (26) is rotatable around its rotating axle 121 which is mounted on the shaft 124 of the drum 26 and front side 51 wall of the mobile frame 50 and can rotate by extending or retracting of the cylinders 123 mounted on the drum motor 122 from one side and horizontal inner upper part 53 of mobile frame 50 from another side.

Similarly the lower cutter drum #1 (70) is rotatable around its rotating axle 127 which is mounted on shaft 128 of the drum 70 and front side 51 of the mobile frame 50 and by extending or retracting of the cylinders 126 mounted on the drum motor 125 from one side and horizontal inner lower part 54 of mobile frame 50 from another side.

And the lower cutter drum #2 (73) is rotatable around its rotating axle 137 which is mounted on shaft 138 of the drum 73 and front side 51 of the mobile frame 50 and by extending or retracting of the cylinders 136 mounted on the drum motor 135 from one side and horizontal inner lower part 54 of mobile frame 50 from another side.

Figure 24:
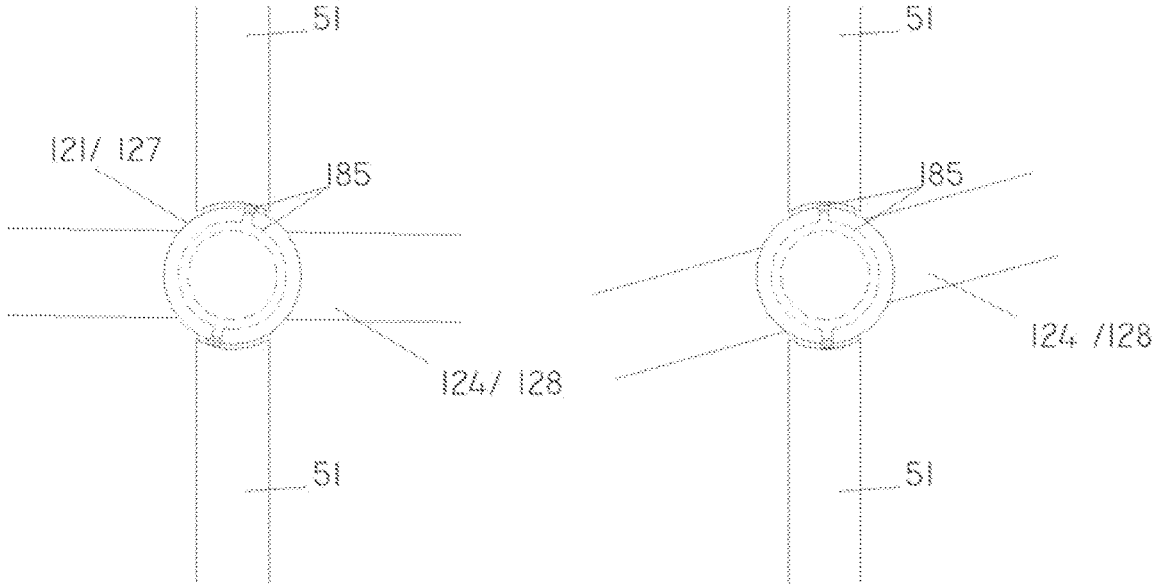

Sidenote: At this example vertical positioning of the drums 26,70 and 73 can be controlled only by rotation, however generally considering moving drums straightly up/down (without rotation) would be possible, however sealing of the only rotating option will be much easier. FIG. 24 is showing an example for sealing of rotating axles 121/127 on front wall 51 of the mobile frame 50 by using drum's sealing gaskets 185.

Similar to the continuous miners, the rotors 21 and 22 are rotating such a way that excavated materials be pushed toward the screw conveyor 28. (Rotor 21 to be rotated at counter-clockwise and rotor 22 to be rotated at clockwise directions).

Also similar to continues miners the bits on the drums 26, 70 and 73 (not shown for clarity) used to be located at helical pattern on the drum surface in order to push the excavated material toward the middle portion of the TDM and close to the screw conveyor 28 and its extended helical extension 38.

Connected parts of the rotors 21 and 22 and drums 26, 70 and 73 on the front side 51 wall of the mobile frame 50 need to be sealed (waterproofed).

As shown at FIG. 1, telescopic extensions 36, 72 and 74 of the drums 26, 70 and 73 have an angle in order to ensure about efficient excavation as the bits can cover the telescopic portion during excavation.

The drums 26, 70 and 73 as well as rotors 21 and 22 will be slightly over cutting front edge of the forward shield 5 to ensure about smoother advancement of the TDM.

Also front edge of the forward shield 5 face are made by sharper angle walls to help digging of the soil/rock at the portions that won't be directly excavated by drums 26, 70 and 73 and rotors 21 and 22.

Other smaller rotors, drums or chain cutter may be needed at locations that are not excavated directly by cutting tools. For example 2 smaller rotors may be added (at north-west and north-east side of the face) between upper drum 26 and rotors 21 and 22 to ensure about efficient excavation of those portions, if necessary. Alternatively chain cutters could be added for the mentioned portions.

At this sample front of the screw conveyor 28 has been kept open and therefore screw conveyor 28 will be also digging its front by the screw conveyor extension 38 in addition to its function that is discharging dug material from front of the mobile frame 50.

Alternatively, lower cutter drums 70 and 73 could be combined (similar to upper drum 26) and in this case extension of the screw conveyor 38 should be shorten.

Sealing Mode

Figure 5:
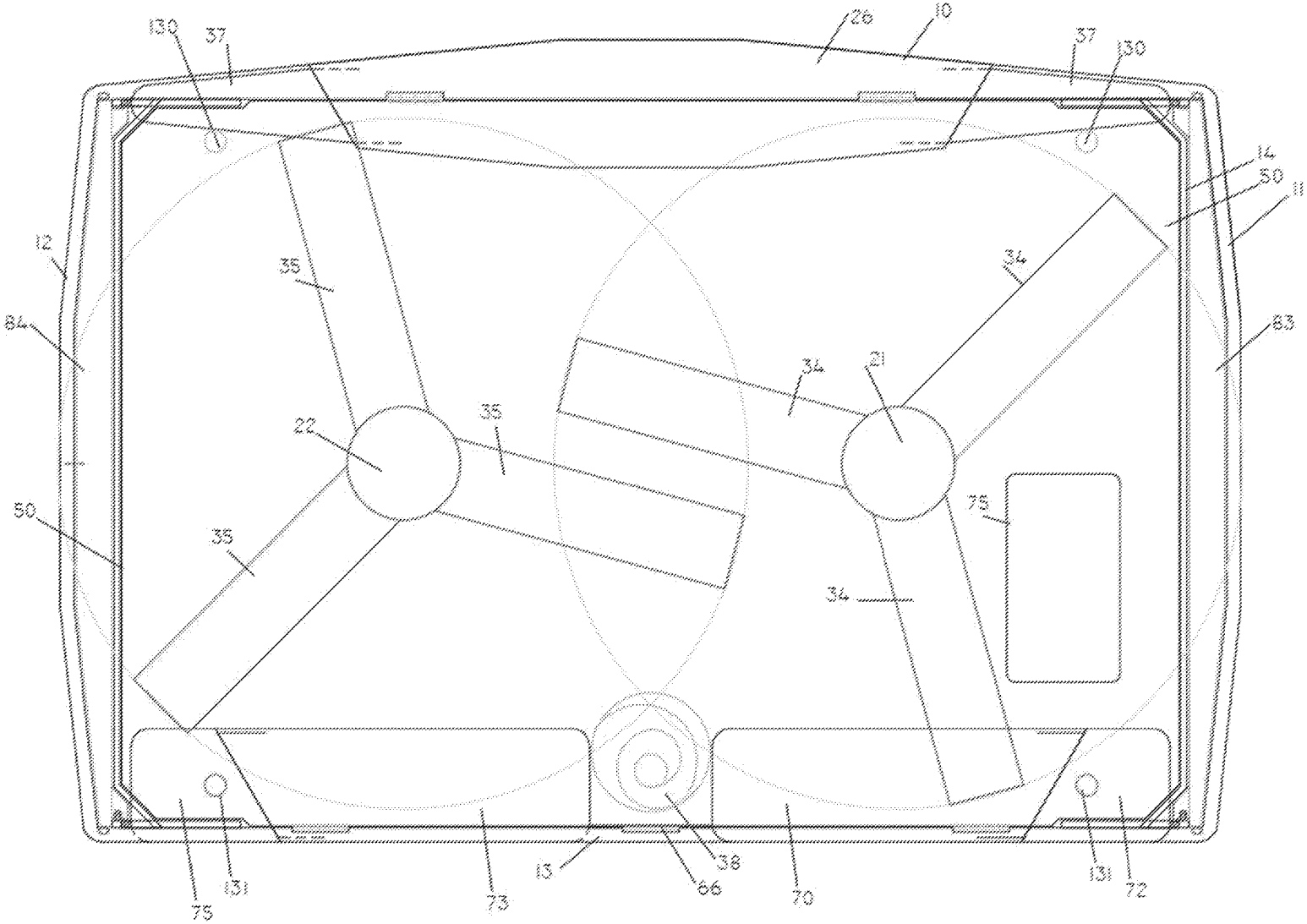
FIG. 5. Front view of TDM at retracting of cutter drums stage

FIG. 5 shows a stage that cutting blades 34 and 35 of the rotors 21 and 22 are in a position that all cutting blades 34 and 35 are located within front side 51 wall of the mobile frame 50 and are not interfering with any of internal skin walls 14 or top side 10 and bottom side 13 within the forward shield 5. At this stage telescopic extensions 37, 71 and 74 of the drums 26, 70 and 73 are retracted as well.

Sidenote: At this example cutting blades 34 and 35 don't need to be shorten, however if a specific TDM needs longer blades 34/35, then they some of them may be designed to be shorten by telescopic extension (similar to drums) or they may be designed to be foldable.

FIGS. 6, 7, 8 and 9 are addressing the sealing mode of the TDM. The upper cutter drum 26 is rotated around its rotating axle 121 by extending the drum cylinders 123 (see FIG. 9) and therefore all parts of cutter drum 26 will be located within mobile frame's 50 front zone. Similarly lower cutter drums 70 and 73 will be rotated around their rotating axle 127 and 137 and by extending their drum cylinders 126 and 136.

By retracting mobile frame thrust cylinders 62, all cutter rotors 21 and 22, cutter drums 26, 70 and 73 and screw conveyor will be retracted to inside of the forward shield 5.

Concurrently stabilizing liquid (e.g. slurry bentonite) will be pumped in via injection gates/valves 130 to provide face stability on the face of the excavation by maintaining the required pressure.

The folding ramps 39 and 40 may need to be folded (or removed) prior to retracting of the mobile frame 50.

As soon as the mobile frame 50 is reached to its final retracted position, the sealing shutter gate 80 of the TDM will be pushed to seal the face of the TDM.

Face Sealing Concept-Shutter Gates

As shown in FIGS. 11-14 (Mobile frame 50, drums 26, 70, 73 and screw conveyor 28 have not shown in these drawings for more clarity), the sealing shutter gate 80 comprises Shutter at straight line 81, Shutter at curve line 82 and end shutter 83/84 at TDM sides of 11/12, that are connected by hinge connections 85 together and can be pushed and pulled by shutter thrust cylinders 24 and will be following the main guide rail 90 and secondary guide rail 93 for their movement. (Other shutter cylinders 25 at upper and lower portion of the shutters 81 have not been shown for more clarity).

Figure 14:
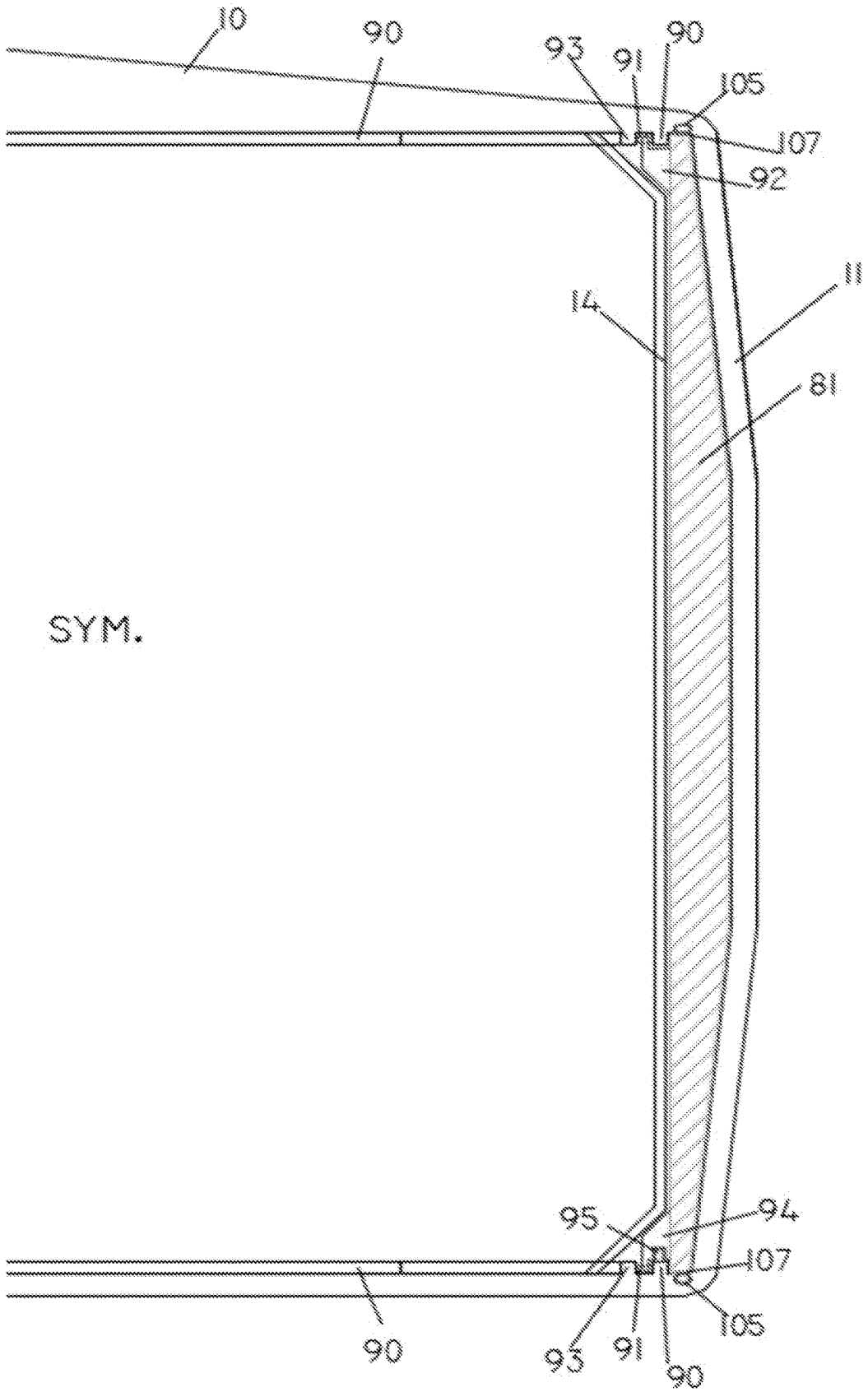
FIG. 14. Section A-A of unsealed (digging) mode

As shown at FIG. 14 the shutters have upper bracket 92 which include roller of shutter 91 and lower bracket 94 that include roller of shutter 91 and wheel 95 under the lower bracket 94.

In order to accommodate the brackets 92 and 95, the internal skin vertical skin walls 14 have been adjusted with angles at its top and bottom portions and mobile frame 50 is also following skin wall 14 shape at its vertical sides.
The access windows may be added on the skin walls 14 for maintenance/cleaning purpose.

Figure 6:
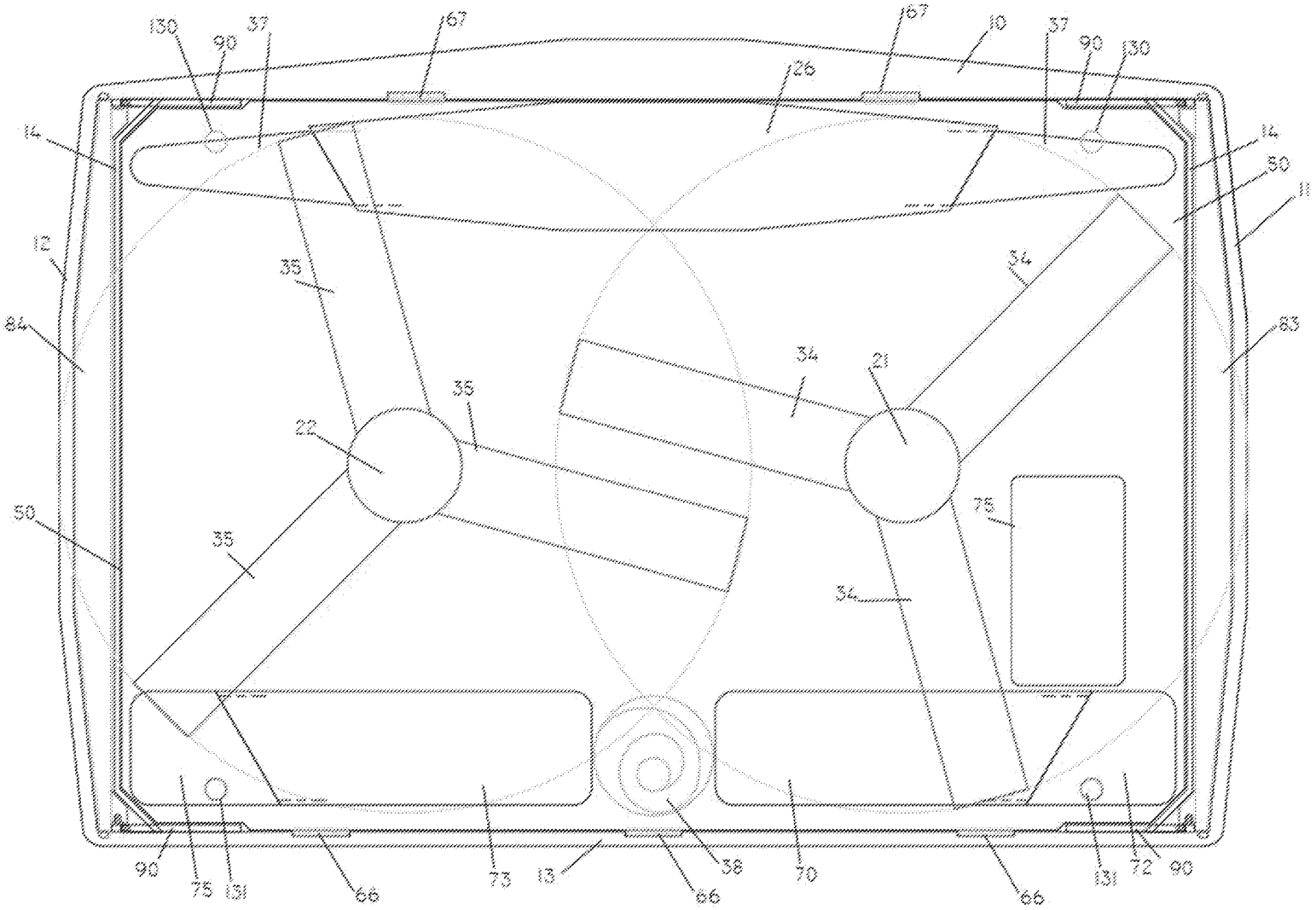
FIG. 6. Front view of TDM at sealing mode
Figure 7:
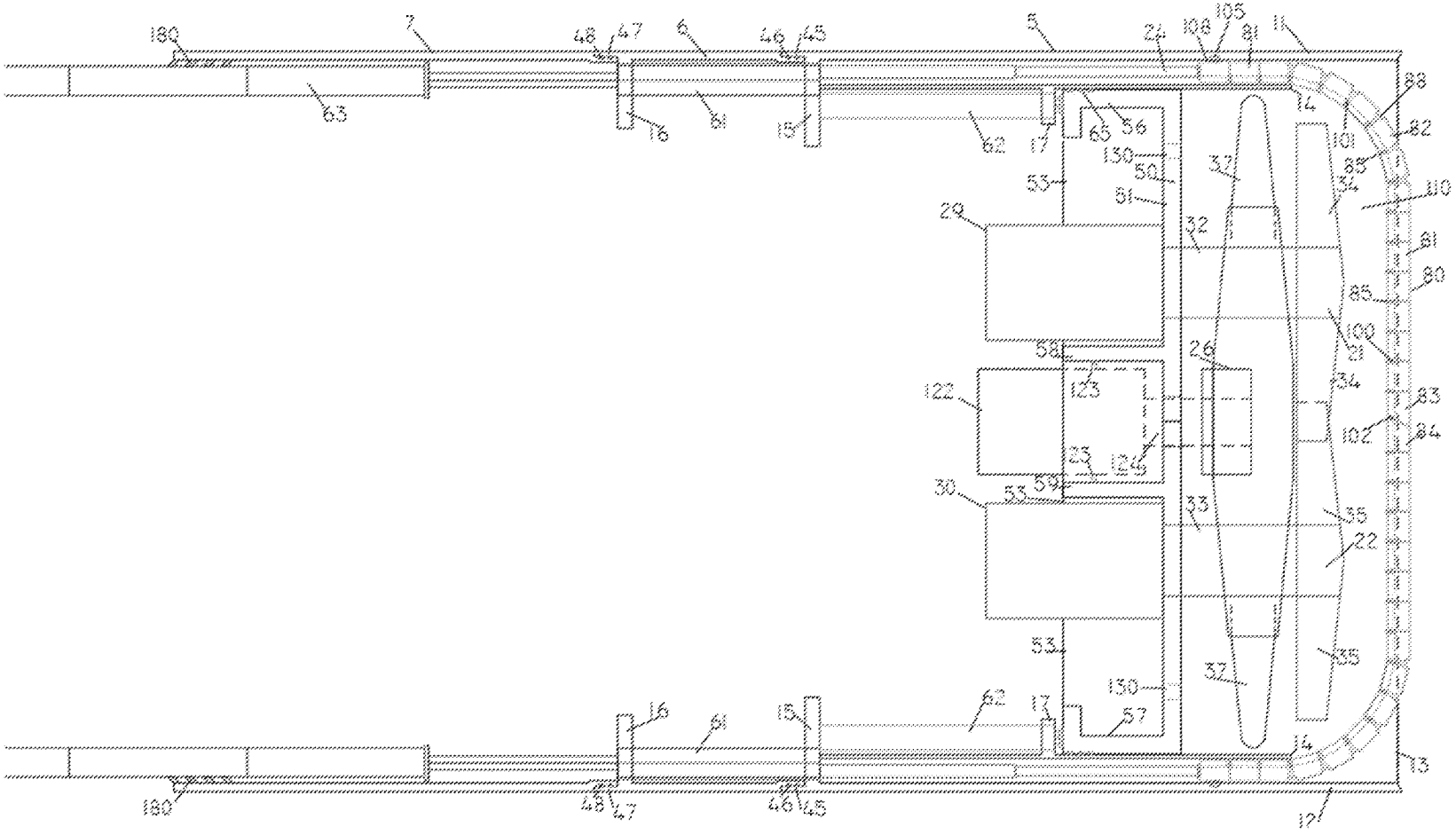
FIG. 7. Plan view of TDM at sealing mode (Section thru middle—Looking Up)

Also Since projection of the main guide rail 90 at its curve portion will be located at mobile frame 50 movement area, the upper part 52 and lower part 55 of the mobile frame 50 may need to be adjusted as shown at FIG. 6.

At the TDM's digging mode, the shutter 81-84 are located between the TDM's exterior walls 11/12 and internal skin walls 14.

Figure 11:
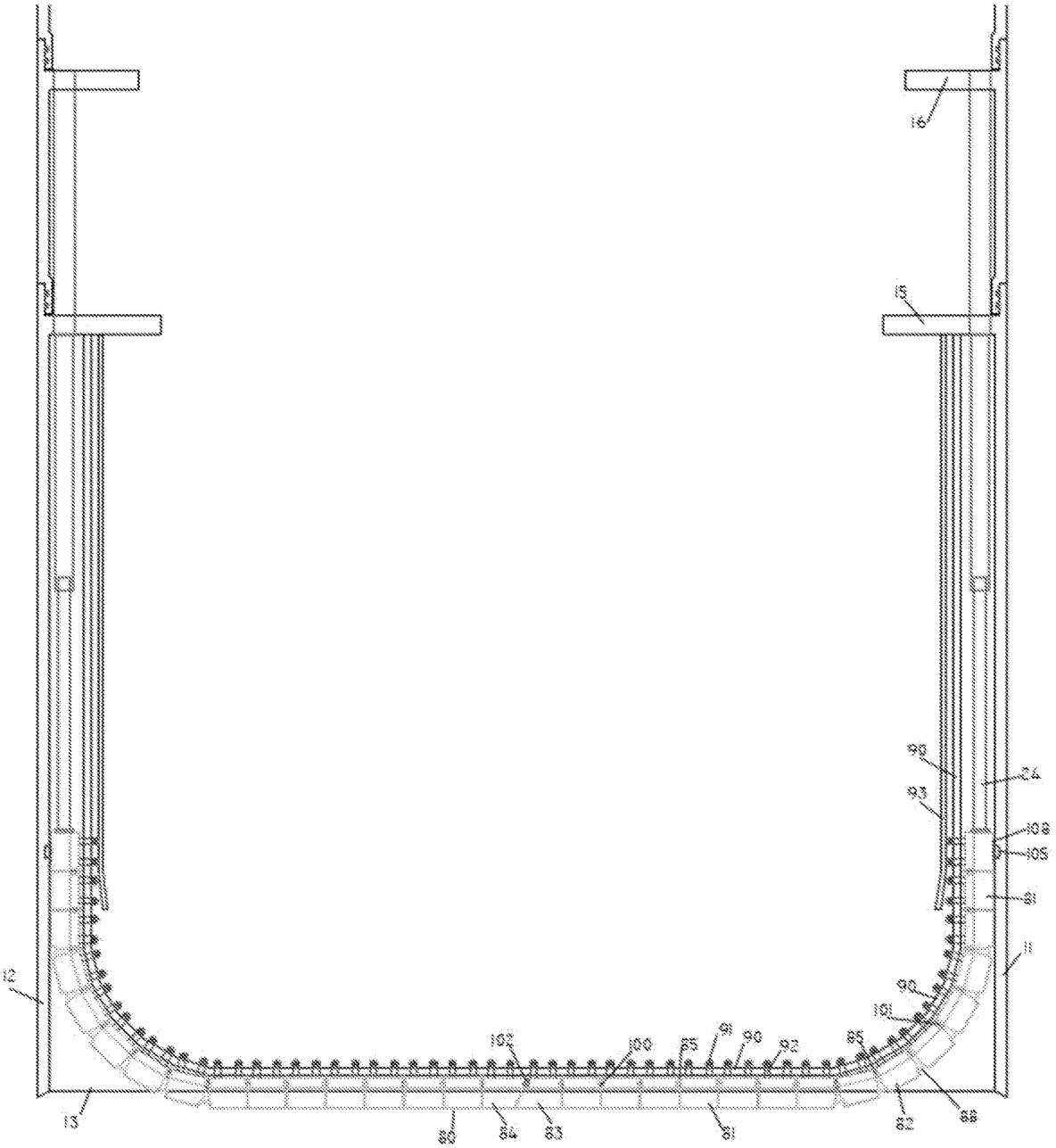
FIG. 11. Plan view of Sealing concept—Section thru middle
Figure 11A:
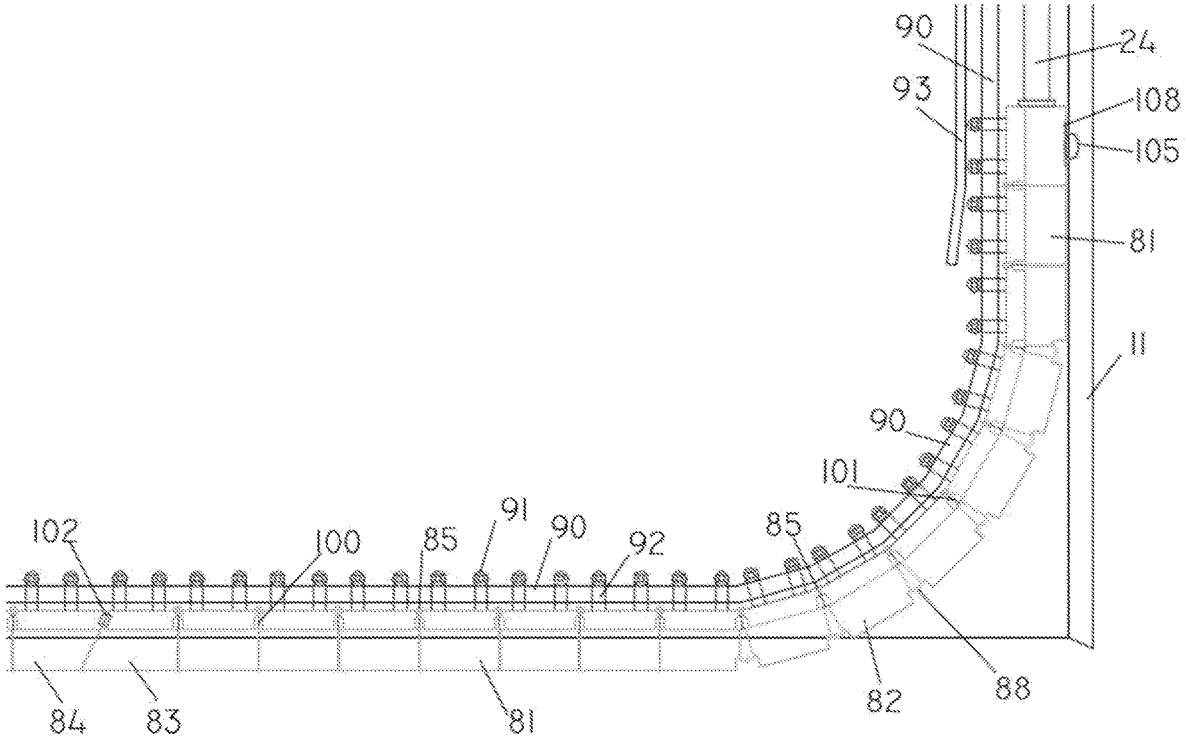
FIG. 11*a*. Zoomed details from FIG. 11
Figure 12:
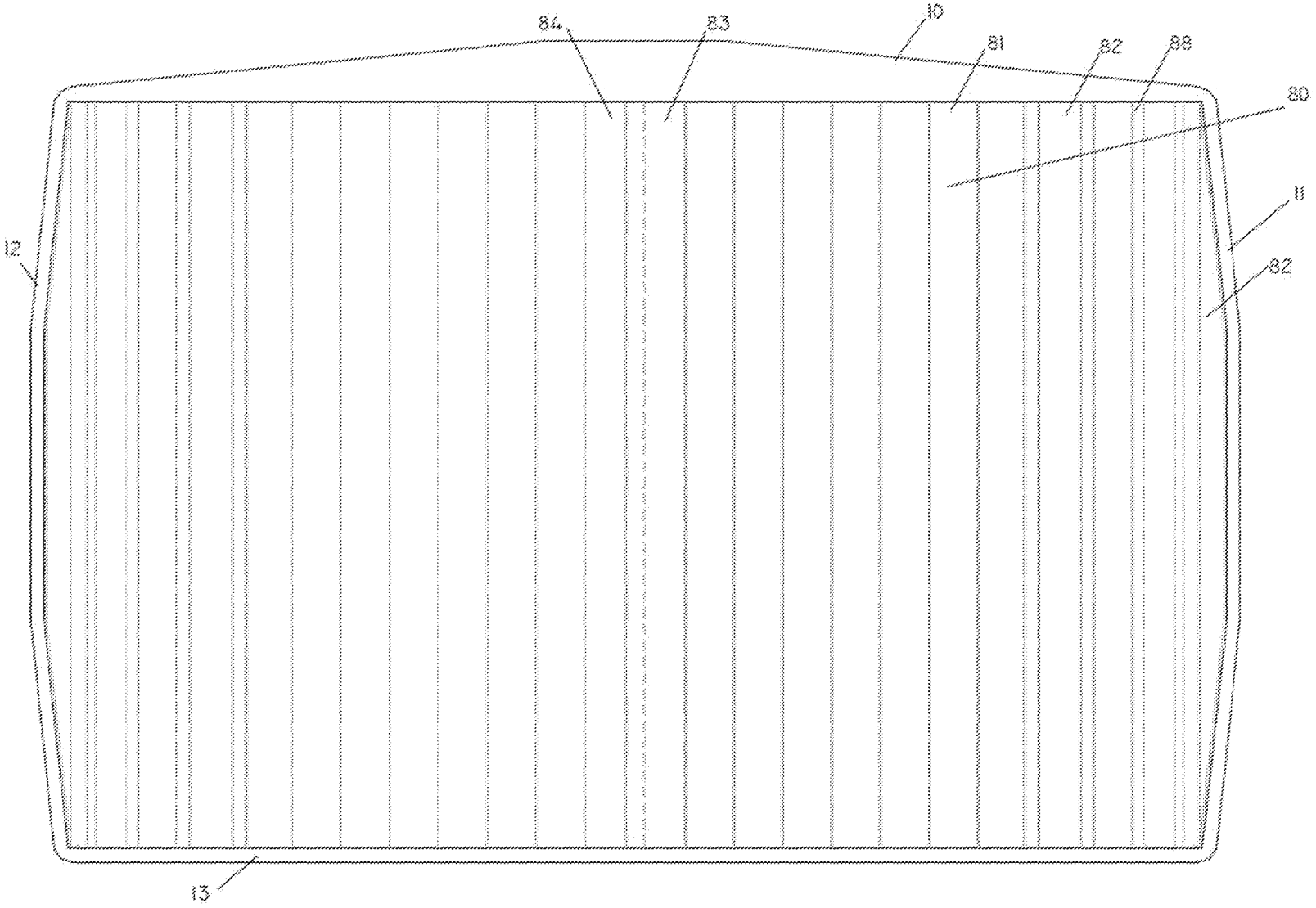
FIG. 12. Front view of Sealing concept

At TDM's sealing mode the shutters 81-84 will be pushed by shutter cylinders 24 and 25 to reach to their location at face of the TDM to make structural wall against the ground pressure as well as sealing against the external water pressure (see FIGS. 11, 11*a* and 12).

At this example, the shutters 81-84 have more thickness at their middle portion to obtain more structural capacity against the ground pressures.

The shutter cylinders 24 can be mainly placed and push/pull from the thicker part of the shutters 81-84. Also shutter cylinder 25 (not shown for clarity) are located almost behind brackets 92 and 94.

A maintenance room/chamber 110 between mobile frame 50 and sealing gate 80 within the front shield 5 will be provided. The remained injected slurry within the chamber 110 will be pumped out via discharging gates 131 before accessing into the chamber room 110 via access door 75.

As shown at the sealed mode of the TDM, regular sealing gasket 100 (similar to gaskets used for typical segmental lining) are used between shutters 81 at straight line. There are enough recesses within the shutters 81 to accommodate the mentioned regular gaskets 100.

For the shutters 82 located at curved portion of the gate, so-called "helical gasket"101 as sealing gaskets 101 (Ordered by TopEng Inc. and patented by Datwyler/Sealable for Helical segmental lining) will be used. Due to fact that there will be larger gap (in most of cases less than 20 mm) between shutters 82 at curves, using regular gaskets 100 won't have proper function at the mentioned curves and therefore helical gasket 101 will be a solution to seal the gap. As shown, there are sufficient recesses on shutters 82 to accommodate the helical gaskets 101.

As protection to the helical gaskets 101, omega shape (U-shape) protection layer 88 are considered as extra layer to shield the helical gaskets 101 at the curved portion of the gate.

The placed regular gaskets 102 on the end shutters 83 and 84 will provide sealing in the middle of the gate after contacting by provided required pressure by shutter cylinders 24 and 25.

Figure 13:
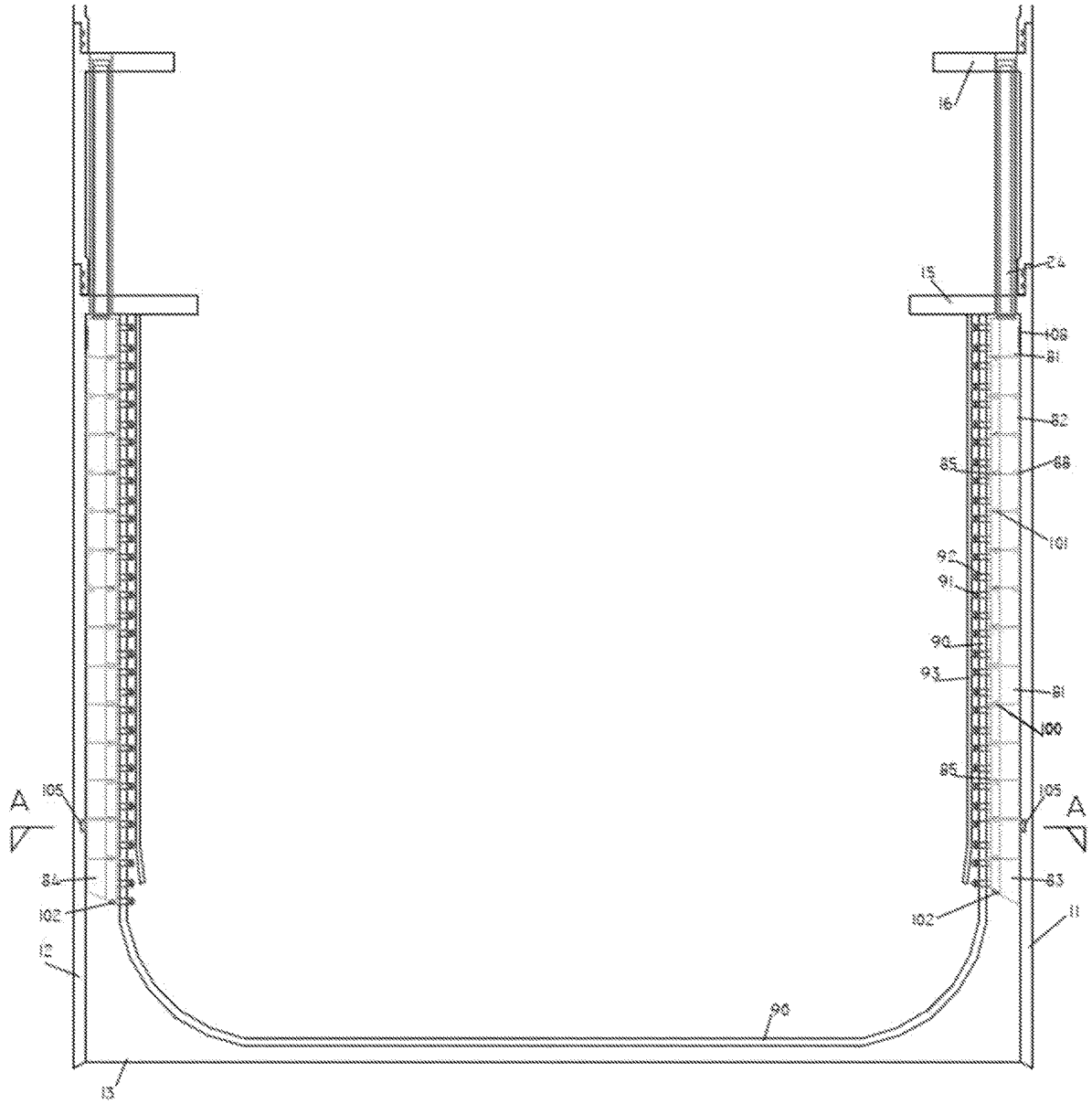
FIG. 13. Plan view of un-sealed (digging) mode—Section thru middle

The shutter gate 80 will be pulled and retracted by shutter thrust cylinders 24 and 25 as shown at FIG. 13 whenever necessary.

Figure 11B:
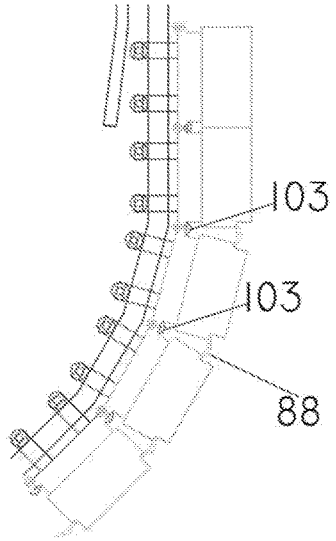
FIG. 11*b*. An alternative to use U-shape (Omega shape) sealings

Alternatively, omega (U-shape) shaped sealing 103 may be connected between shutters 82 at curve or all shutters 81-84 for sealing of vertical gaps between them as shown at FIG. 11*b*. The required recesses on the shutters will be provided to accommodate the mentioned omega sealing 103. The omega sealing 103 will be able to flatten or curved wherever necessary and will always have sealing function.

Figure 15:
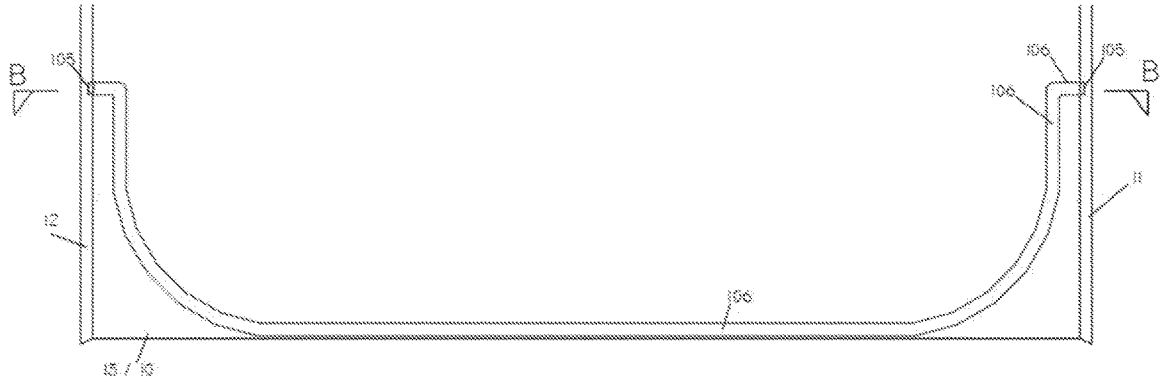
FIG. 15. Plan view of inflatable sealing layout
Figure 16:
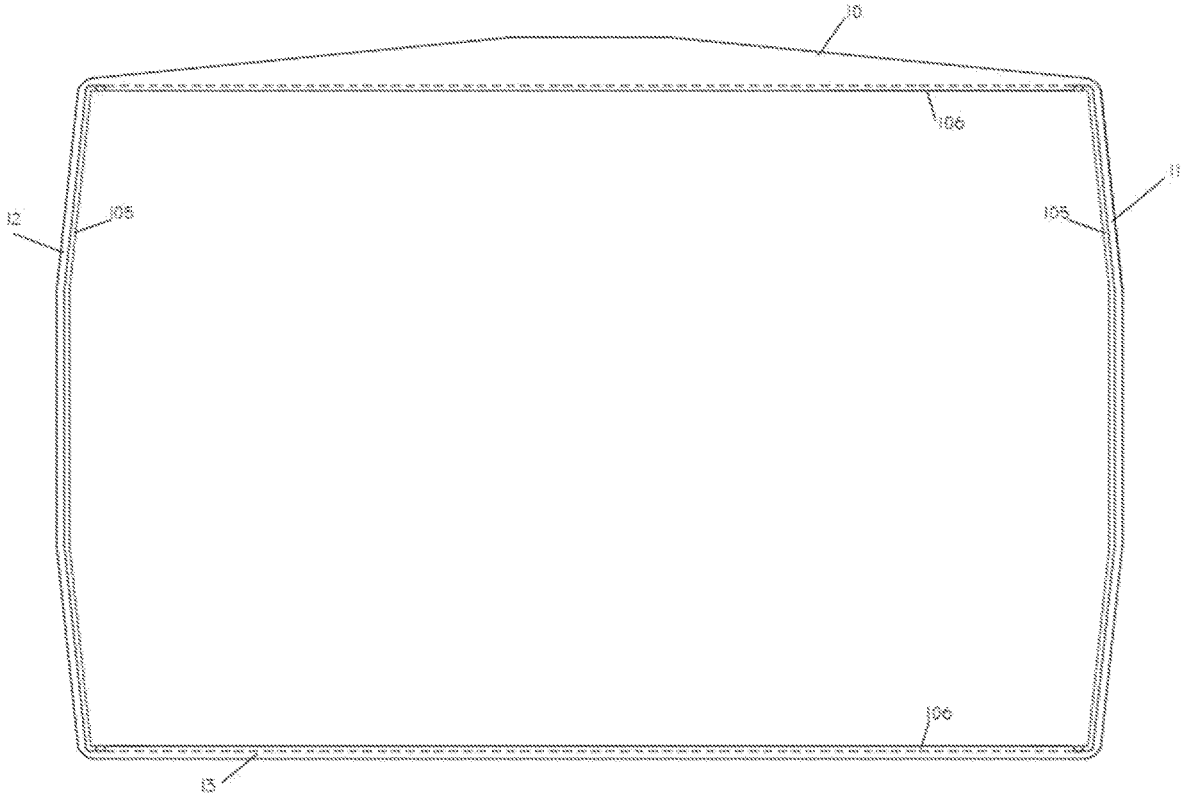
FIG. 16. Section B-B—Inflatable sealing layout

As shown at FIG. 14, in order to seal vertical gap between shutter gate 80 and TDM's walls 11 and 12, inflatable sealing 105 is proposed. Further, in order to seal horizontal gap between upper and lower parts of the shutters 81-84, the inflatable sealing 106 will be located within TDM's crown 10 and base 13 and shutters 81-84 upper and lower end locations at TDM's sealing mode (See FIGS. 15 and 16).

At the sealing mode of the TDM, the mentioned inflatable sealings 105 and 106, which are connected and make a full ring, will be inflated to seal the explained vertical and horizontal gaps between shutters 81-84 and TDM exterior walls 10-14.

To accommodate the inflatable seals 105/106, grooves (recesses) are made within the TDM's exterior shields 10-14. However alternatively the inflatable seals may be projected out of the exterior shields which in this case adjustment on the shutters 81-84 and their brackets 92 and 94 would be required.

For better contact between inflatable sealings 105 and shutter 81, sealing pad 108 may be added on an individual shutter 81 that will be located front of the inflatable sealing 105 during sealing mode.

Similarly for better contact between inflatable sealings 106 and upper and lower ends of the shutters 81-84, sealing pads 107 may be added on upper and lower end portions of all shutters 81-84. (See FIGS. 14 and 11*a*).
Also in order to protect inflatable sealings 106, a protection board 141 may be attached to front of front side wall 51 of the mobile frame 50, if necessary (See FIG. 4) The same may be added at top of the frame 50, if needed.

Sidenote: As an alternative, the pulling and pushing of the shutter gate 80 may be done by utilizing winches at both ends to pull the shutter gate 80 back and forth, instead of using shutter gate cylinders 24 and 25.

Maintenance

The maintenance (bit changes, disc changes, repairs, etc.) of all elements at front face of the mobile frame 50 including all cutter rotors 21 and 22 and cutter drums 26, 70 and 73, screw conveyor and its extension 28 and 38 and etc.) will be all possible within provided maintenance room/chamber 110 between mobile frame 50 and sealing gate at atmospheric pressure in the TDM.

An access door 75 (or more) will provide access into the maintenance chamber 110 for the maintenance activities. (see FIG. 6)

Return to Digging Mode

The chamber 110 will be re-filled again with stabilizing liquid (e.g. bentonite slurry) via injection gate/valve 130 and then the shutter gate 80 will be pulled back by retracting its cylinders 24 and 25 and the mobile frame 50 along with its all mounted elements (21, 22, 26, 70, 73, 28) will be pushed back to their operation position by extending thrust cylinder 62 of the mobile frame 50. As mentioned utilizing the rollers 66 and 67 under and above the mobile frame 50 will ease the movement of the mobile frame 50.

Concurrently stabilizing liquid (e.g. slurry bentonite) may be discharged via discharging gate/valves 131. The cutter drums 26, 70 and 73 will be rotated and extended to position at their digging mode to resume the digging operation.

Note that stabilizing liquid (e.g. bentonite slurry) may be reusable/recyclable in the TDM. Also stabilizing liquid may be used during digging operation to maintain and balance the earth pressure.

Sidenote: As an alternative and in a completely different design of TDM, the mobile frame 50 may be fixed and external walls 10-13 within forward shield 5 will be pushed/pulled along with their accommodated sealing shutters 80 to provide digging or sealing modes of the TDM . . . .

TDM Continuous Segment Installation and Excavation (Advancement)

Installation of the segments 63 and pushing the TDM forward will be done in similar way of the conventional TBMs by using segment erector 165 and thrust cylinders 61 within stationary shield 6 and tail shield 7 of the TDM.

Figure 17:
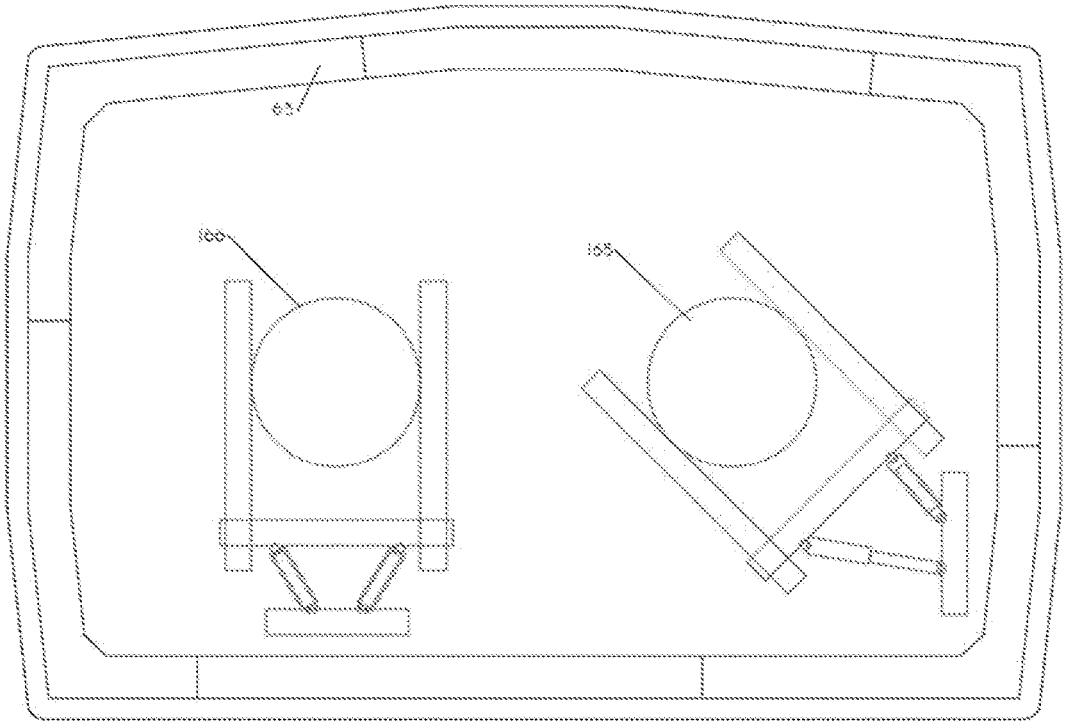
FIG. 17. Possibility of using 2 segment erectors in TDM

However due to provided flat or semi-flat base in TDM, utilizing 2 segment erectors 165 and 166 (or more) will be possible in TDM. (See FIG. 17) which should almost double speed of the segment installation.

Sidenote: For rock tunnels, utilizing grippers (similar to Rock TBMs) would be feasible at TDM as well. Also TDM will work well for the tunnels that their alignment change from rock to soil and vise versa due to easy access and change of the cutting tools within the chamber 110.

Further, excavation and segment installation in conventional TBMs is a sequential process. I.e. the TBM excavation and advancement must be stopped during segment erection), therefore it is highly recommended to utilize one of below mentioned new inventions to avoid stopping of the machine's excavation and advancement while segment installation:

1) Thrust Shell System (TSS) —Invented and Patented by TopEng Inc., PCT #WO 2020/172195 A1

A system and method for simultaneous excavation and segment erection of TBM/TDM by Thrust shell system is an invention in tunnelling industry which will provide possibility of erection of the segmental ring while TOM/TBM is excavating and advancing forward with minimum interruption which will result in significantly increasing the tunneling speed. The increased speed of the tunnelling will be reducing cost of the construction expressively. At this method, the TBM thrust cylinders will be pushing against previously installed segmental ring via combination of thrust shell and an expandable ring while a new segmental ring is being built by TBM's segment erector within the thrust shell's provided inner space.

(Note: Patent document of the TSS is showing circle section tunnel, however the TSS is adoptable to be used in TDM and match with its cross section)

2) Helical Segmental Lining—Invented and Patented by TopEng Inc. —PCT #, USPTO #WO 2019/160638 A1

The Helical segmental lining is an invention in the tunneling industry wherein segments are designed in a helical shape that are connected by an interlocking system. The proposed helical tunnel lining method allows for segment erection and excavation to be completed concurrently and continuously by a TDM/TBM which will result in increasing the tunneling speed. The segments have tongue projections on the two trailing sides (circumferential and radial) and similar groove recesses in the opposite two leading sides. This forms a tongue-and-groove joint at both the circumferential and radial joints. The system allows for an optional post-tensioning (PT) strand to be inserted into the leading circumferential side of the segments as well. The system has solutions for alignment curves by turning of the helical segmental lining and sealing of the system. Note that helical lining is adoptable for TDM's different cross sections.

Figure 19:
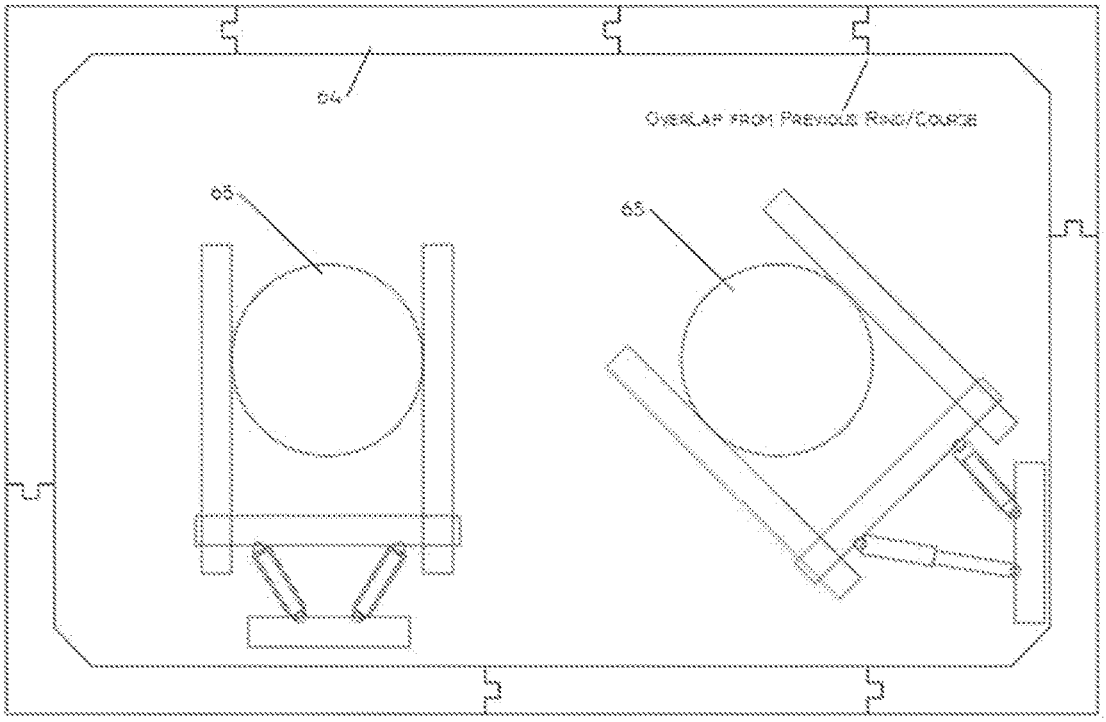
FIG. 19. A sample of using Helical segmental lining in TDM

A sample of helical lining cross section is shown at FIG. 19 with a rectangular section in TDM by using helical segments 64.

New System for Lining at Curves

Precast segmental lining may be considered as one of main type of linings for the TDM. Either conventional segmental ring or helical segmental lining may be used as lining of the TDM (or TBM).

Figure 10A:
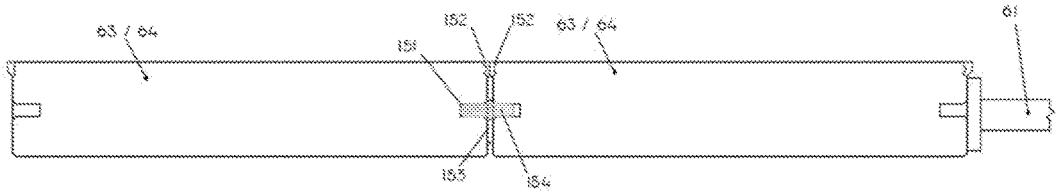
FIG. 10*a*. New lining proposal—Before connection at curve (Conventional/Helical lining)
Figure 10B:
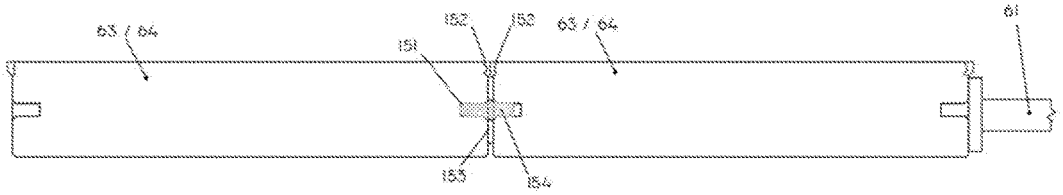
FIG. 10*b*. New lining proposal—After connection at curve (Conventional/Helical lining)
Figure 10C:
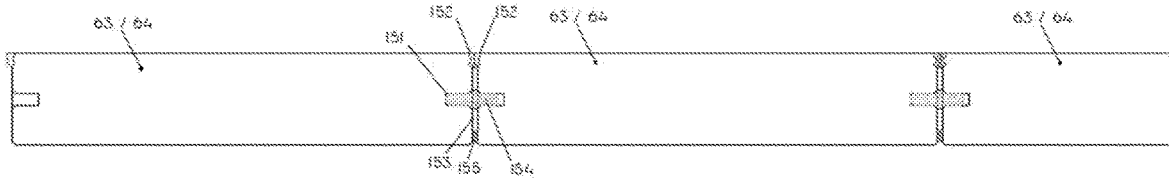
FIG. 10*c*. New lining proposal—Optional Gap filler added (Conventional/Helical lining)

Due to non-circle cross section, a new system is proposed to deal with the curved alignment and sealing of the lining (See FIGS. 10*a*, 10*b* and 10*c*) which can be used at any tunnel section shape (Circle, elliptical, square, rectangular, sub-rectangular, horseshoe, etc.) and in conventional ring or helical lining systems.

- The Spacers/tapers 153 (for example with max 25 mm) are used between segments (conventional segments 63 or helical segments 64) in similar way that has been described in helical segmental lining patent documents to provide the curves at circumferential sides of the segments. The spacers 153 will have holes at location of the dowels 154 at the circumferential side of the segments 63/64.
- The so-called continuous "Helical gaskets" 152 are special gaskets (Developed & patented by Datwyler/Sealable for TopEng Inc.) and used at circumferential sides as they will be able to seal the large gaps due to placing of the thick spacers 153.
- The gap/joint left at the inner surface of the lining may be filled by joint filler 155 optionally at a later stage to provide a smooth tunnel surface.
- Bolt connections, interlock (tongue and groove), dowels and etc. may be used at radial sides of the segments 63/64.
- Either normal gaskets or helical gaskets may be used at radial sides of the segments 63/64, similar to conventional lining.

As stated, this proposed system for curve may be generalized to be used for linings of TDM or TBM and with either helical or conventional segmental lining.

TDM's Mucking

Figure 3:
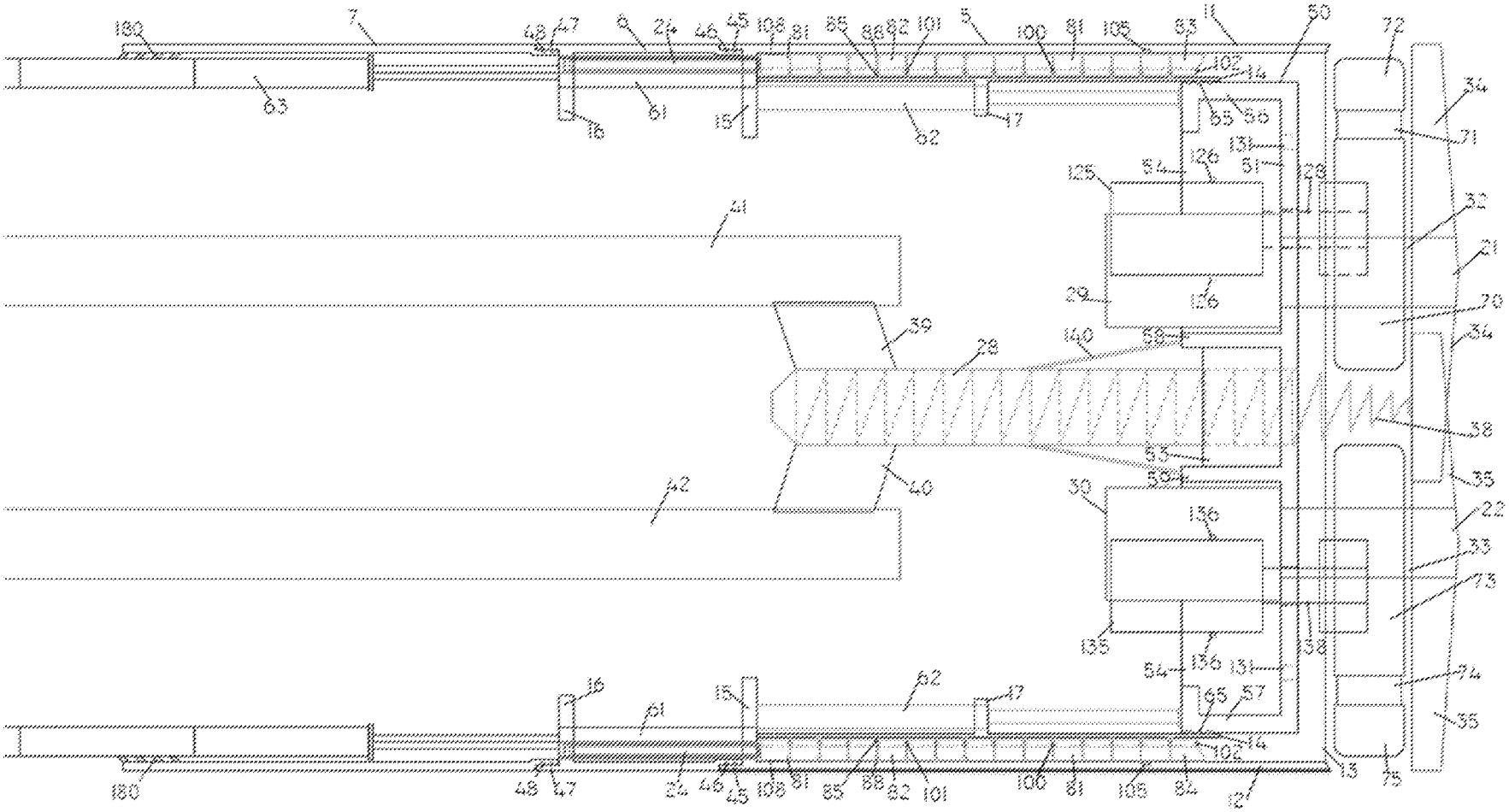
FIG. 3. Plan view of TDM at digging mode (Section thru middle—Looking Down)
Figure 4:
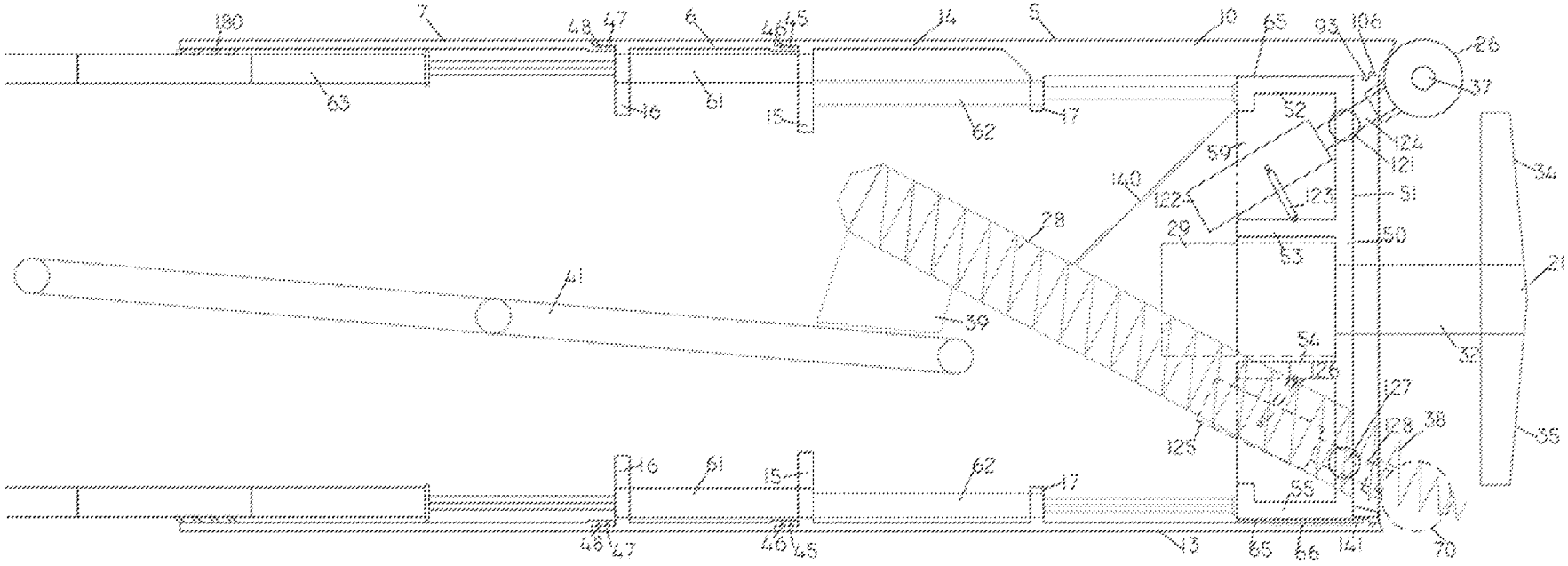
FIG. 4. Longitudinal Section of TDM at digging mode (Section thru middle)
Figure 8:
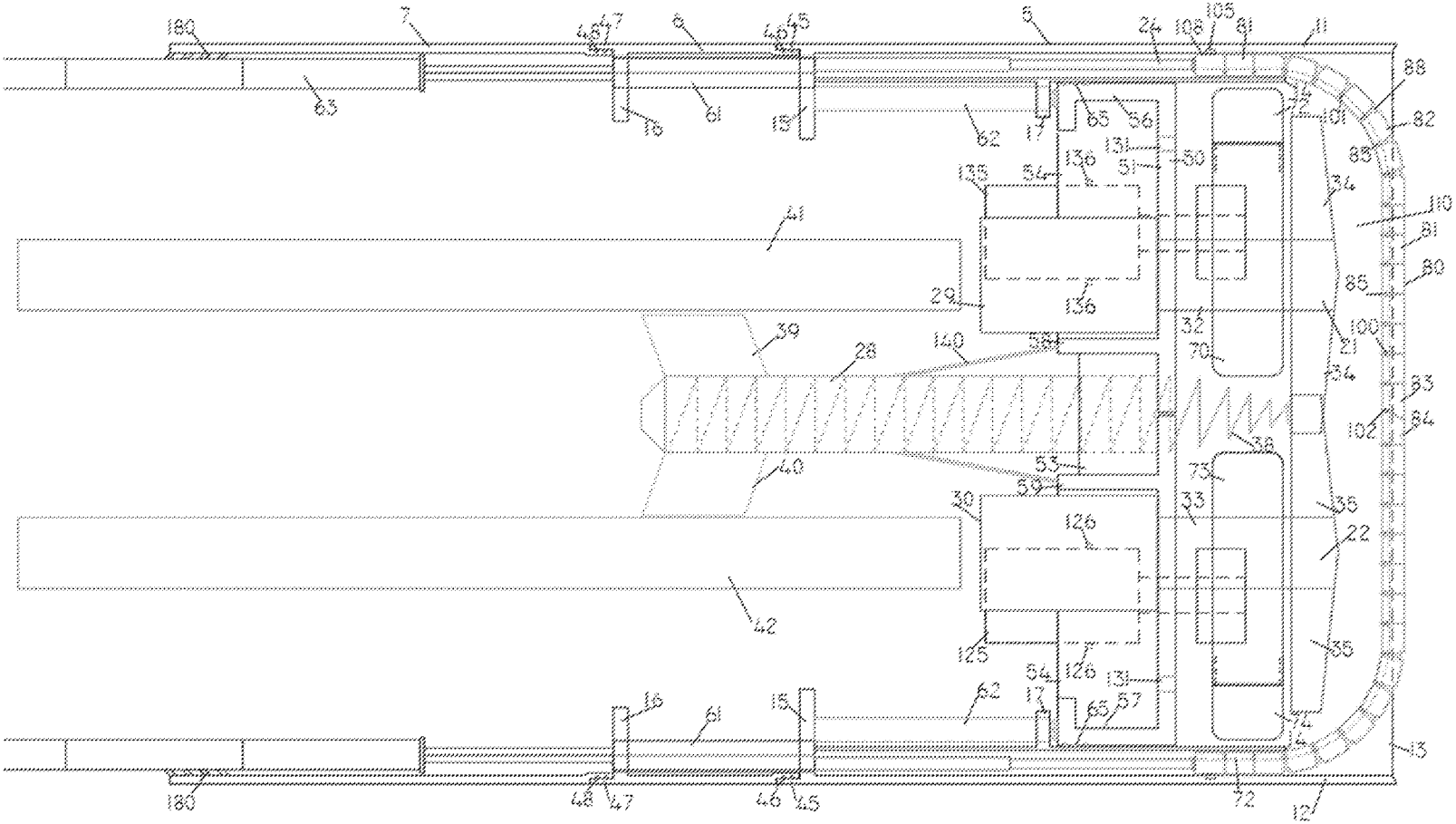
FIG. 8. Plan view of TDM at sealing mode (Section thru middle—Looking Down)
Figure 9:
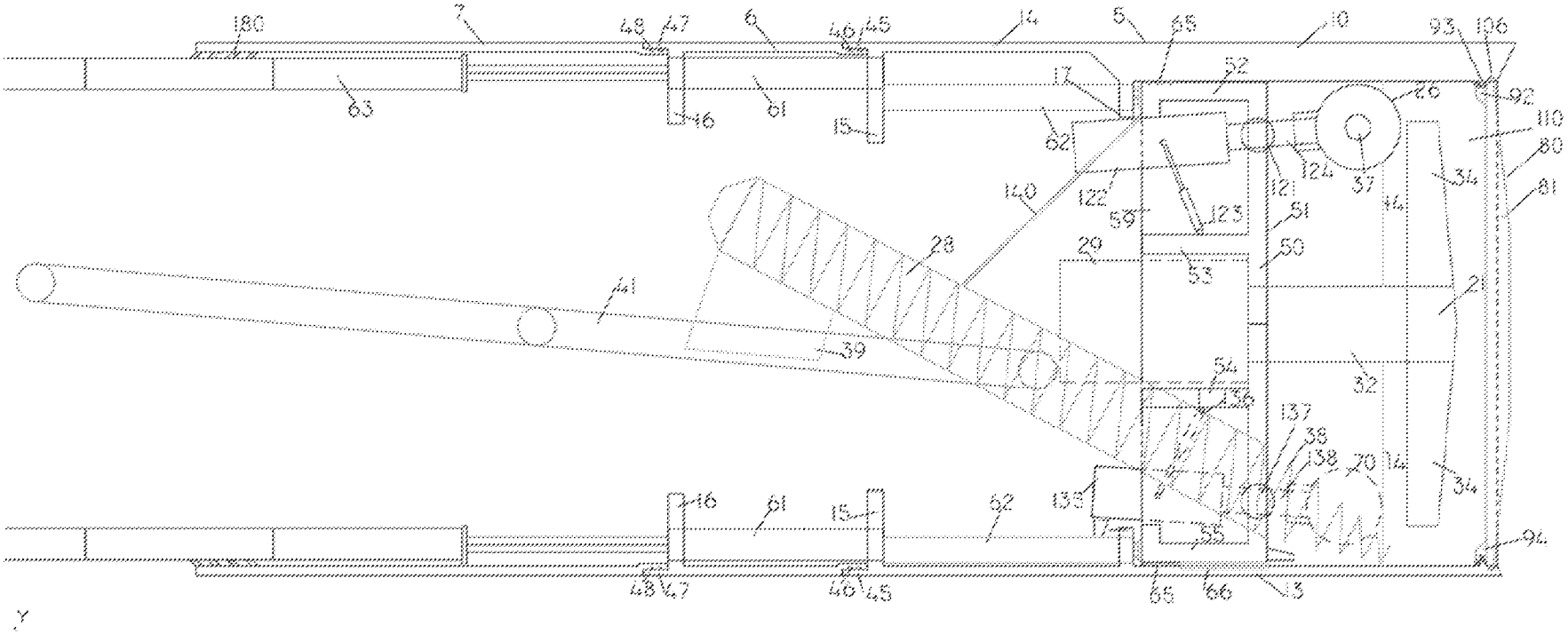
FIG. 9. Longitudinal Section of TDM at sealing mode (Section thru middle)
Figure 18:
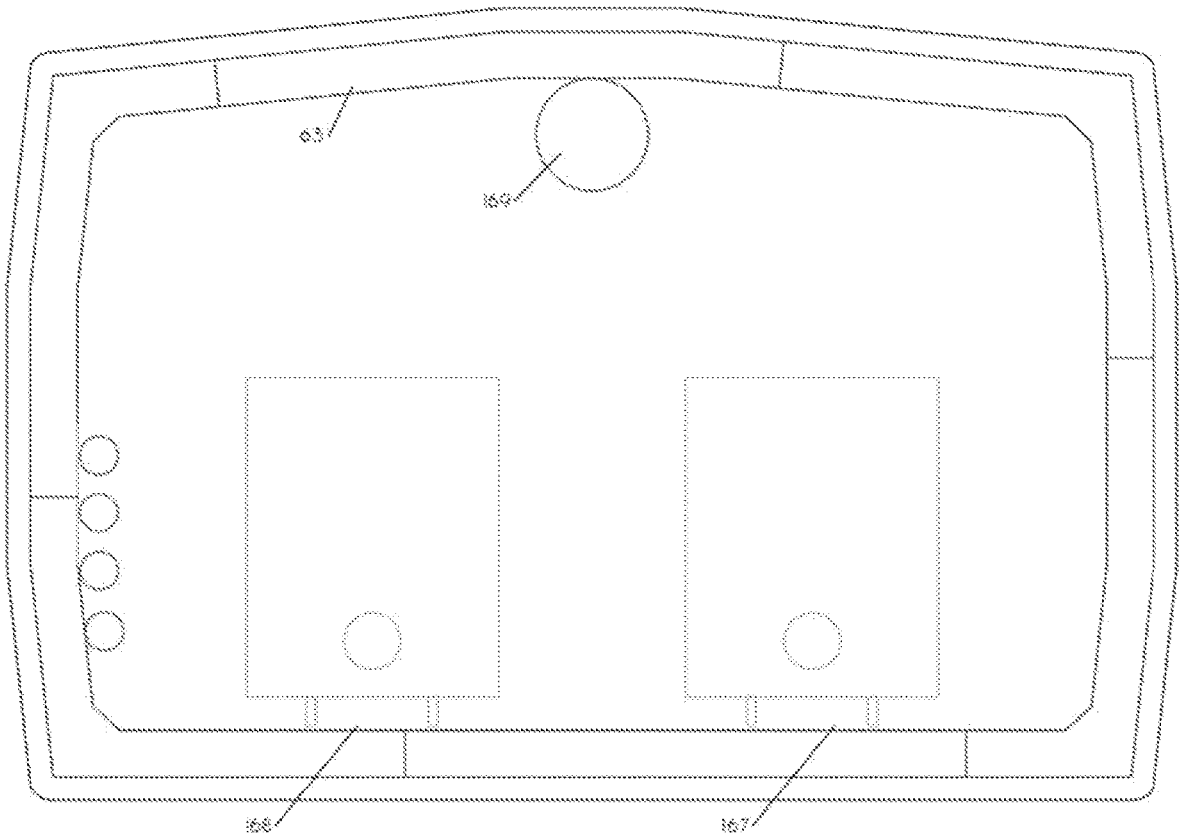
FIG. 18. Possibility of using 2 mucking lines/rails in TDM

The mucking operation in TDM will be done in similar way of the conventional TBMs by muckboxes, conveyor belt system, etc., however due to possibility of maintaining flat (or semi-flat) bottom of the tunneling by TDM, there will be sufficient space for 2 lines/rails (or more) for mucking 167 and 168 (See FIG. 18) or 2 (or more) conveyor belt systems in most of the cases which will be fed by placed 2 belt conveyors 41 and 42 (or more) shown at FIGS. 3 and 8. Using double mucking lines 167 and 168 will be almost doubling the mucking operation speed in the TDM.

TDM's Turning and Articulation

Turning and articulation of the TDM will be done similar to the TBM. Articulation overlap 45 is located between forward shield 5 and stationary shield 6 with its sealings 46 and articulation overlap 47 45 is located between stationary shield 6 and trail shield 7 with its sealings 48. More articulation overlaps/joints may be considered within the forward shield 5. For instance it may be added at internal frame 17 area as well (See FIG. 4), however if it is added, the forward shield 5 may need to be in straight position just before going to the sealing mode to avoid jamming of the mobile frame 50 within the forward shield 5.

The Articulations cylinders and connections between forward shield 5 and stationary shield 6 and tail shield 7 will be similar to TBM and have not been shown for clarity.

Different Cross Section Examples

Figure 20:
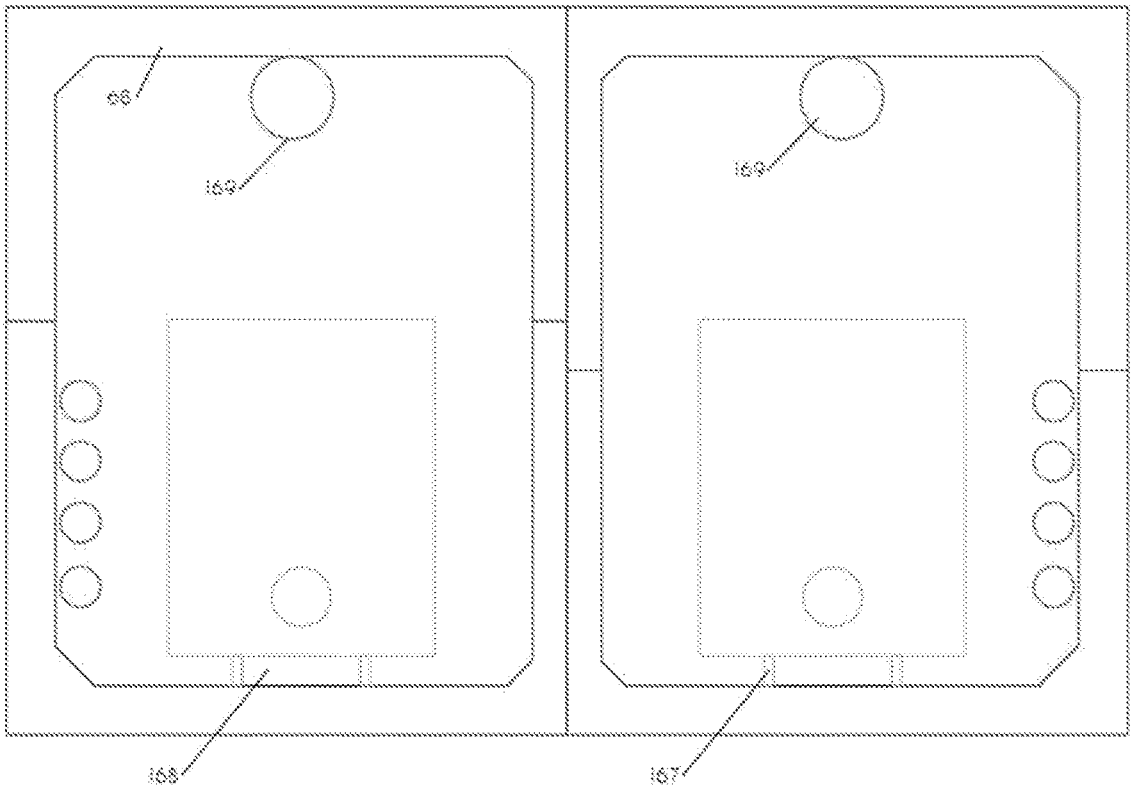
FIG. 20. A sample of using U-shape linings in TDM

FIG. 20 is showing precast U-shape pieces have been assembled in a TDM tunnel.

Figure 21:
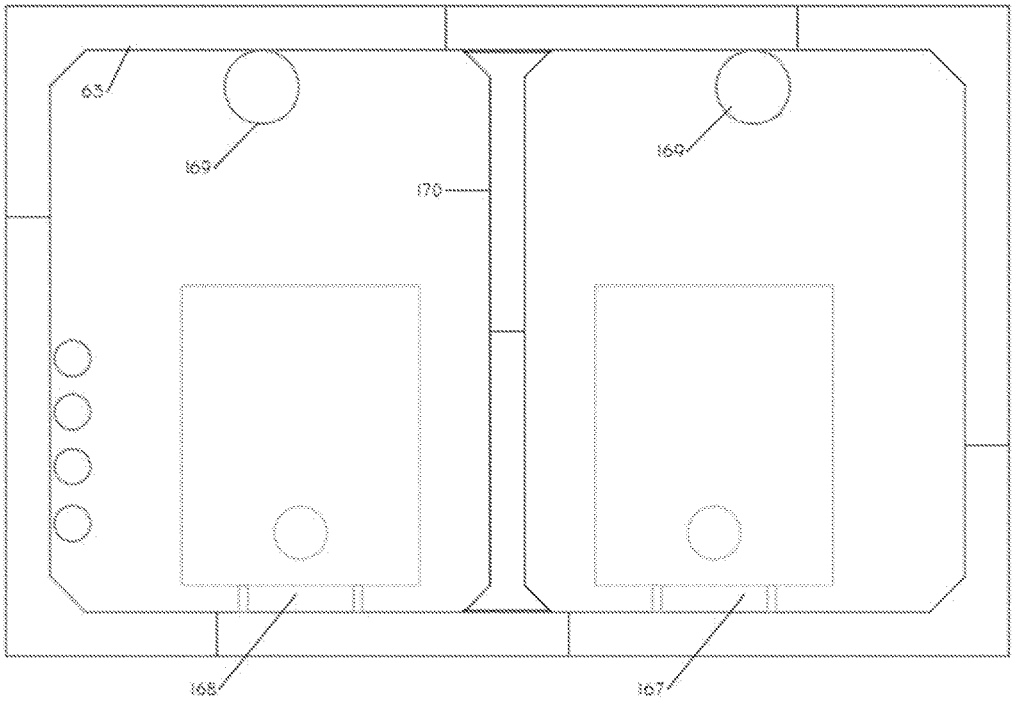
FIG. 21. A sample of considering columns in lining of a TDM

FIG. 21 is showing a rectangular lining section in TDM with additional column 170 in the middle. The vent pipes 169 have been also shown at these figures.

Less Excavation by Optimized Sections in TDM

Figure 22:
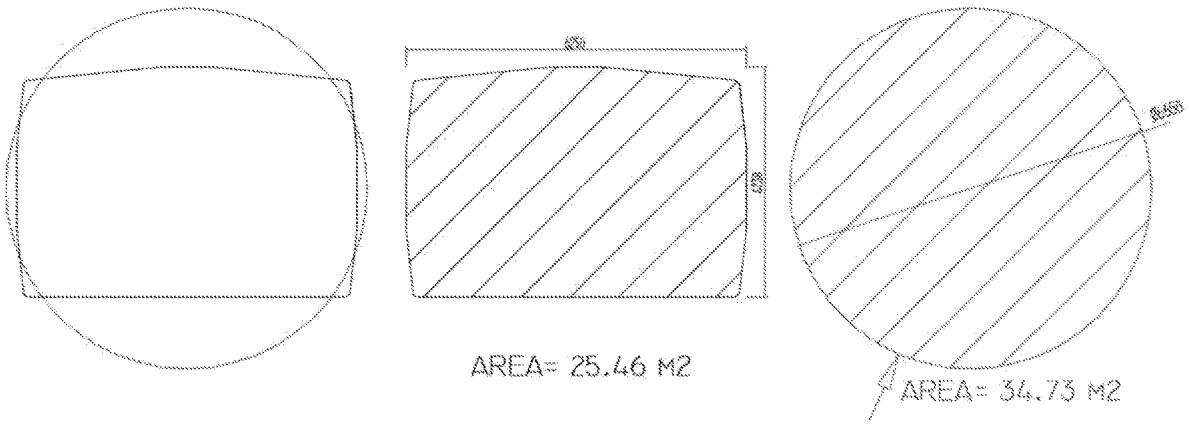
FIG. 22. A sample of comparison showing required less excavation in TDM by optimized section FIG. 23. Added supports around rotor's shafts FIG. 24. An example of sealing the cutting drum's rotating axle FIG. 25*a*. Front view of dome gates in TDM—Digging mode FIG. 25*b*. Plan view of dome gates in TDM—Digging mode FIG. 25*c*. Plan view of dome gates in TDM—Sealing mode FIG. 26*a*. Front view of domegates in TBM—Digging mode FIG. 26*b*. Plan view of domegates in TBM—Digging mode FIG. 26*c*. Plan view of dome gates in TBM—Sealing mode

FIG. 22 is displaying an example for comparison between excavation of a circle tunnel with 6.65 m dia. by TBM for a common size of a metro tunnel and optimized excavated section with semi-rectangular shape of 6.25 m×4.26 m by TDM and as result the TDM will need to dig 26.7% less soil/rock at this case.

Estimated Advancement Rate TDM Vs. TBM

Theoretically by doubling segment erectors and mucking rails speed of the tunnelling should be almost doubled in TDM in any kind of soil/rock Further by utilizing TSS or Helical lining in TDM, speed of tunnelling should be almost 1.80 times faster than conventional TBMs. (Refer to patent document of TSS and Helical lining)

Accordingly, speed of tunnelling by TDM may be almost 2×1.8=3.6 times faster than conventional tunnels by TBMs, (theoretically).

In addition, due to providing easy access for maintenance and bit/disc changes, more aggressive cutting tools (bit/disc, etc.) may be used which would increase the speed further in TDM.

And as noted, reduced amount of excavation by TDM due to its possible optimized sections would also help to reduce construction period of the tunnel as well in comparison with the TBM.

Alternative Sealing Concept—Dome Gates

Figure 25A:
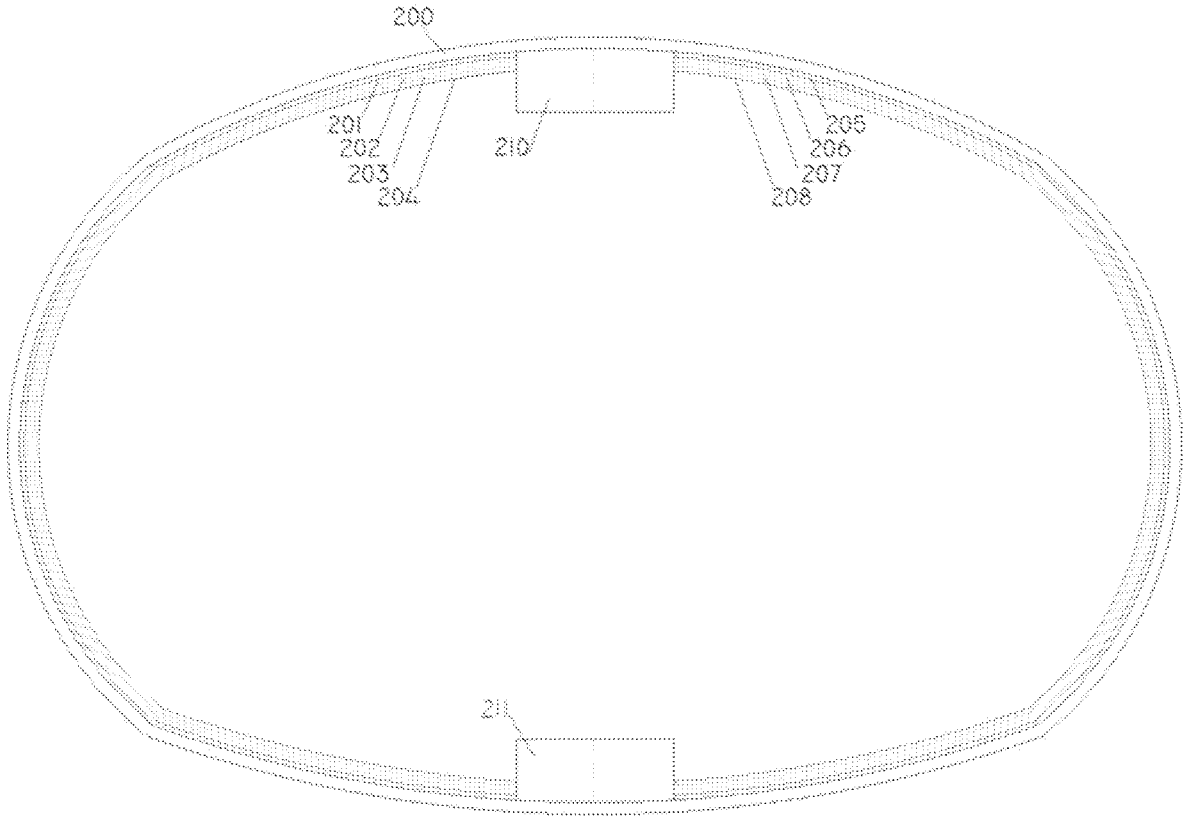

FIG. 25*a* is showing front view of an example of forward shield 200 with a semi-horseshoe shape that is comprising slice dome shape gates 201-204 at one side and slice dome gates 205-208 at other side of the gearboxes 210 and 211 at top and bottom of the Forward shield 200 respectively. The slice dome gates 201-208 shapes have followed and matched with the TDM's forward shield 200 interior shape which means that this method of sealing may be adopted for any desired shape with flexibility. Nos. of the required dome gates may be changed in detail designs as per requirements.

Figure 25B:
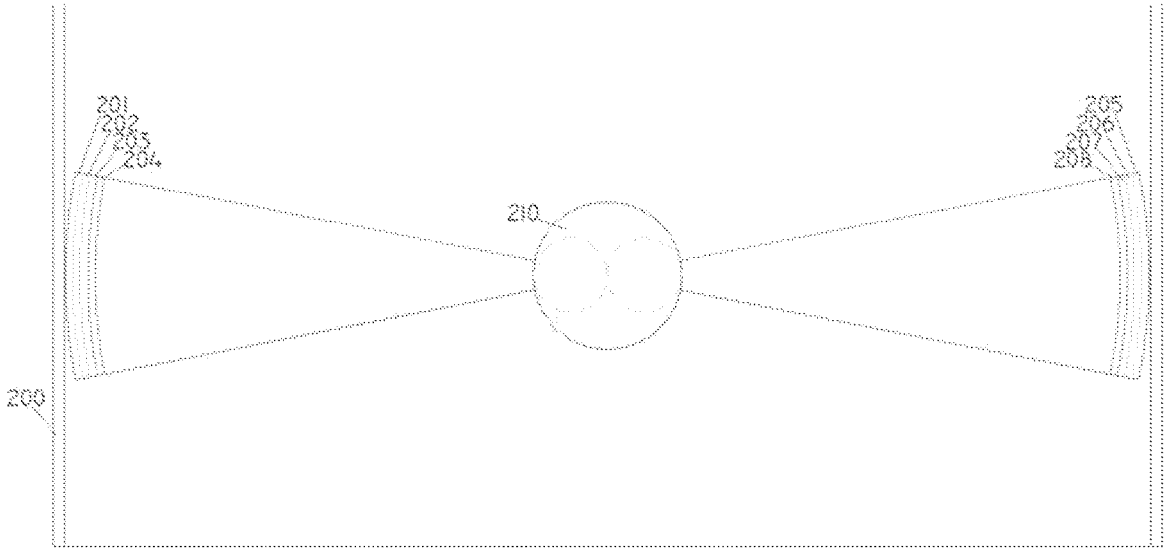

FIG. 25*b* is the plan view of the FIG. 25*a* at digging mode of the TDM. The external radius/dimension of slice dome gate 202 is slightly less than internal radius/dimension of slice dome gate 201 and therefore slice dome gate 202 can be located inside of the slice dome gate 201. Similarly, other slice dome gates can be located/rotated within their neighbour slice dome gates as shown at FIGS. 25*a* and 25*b*.

Figure 25C:
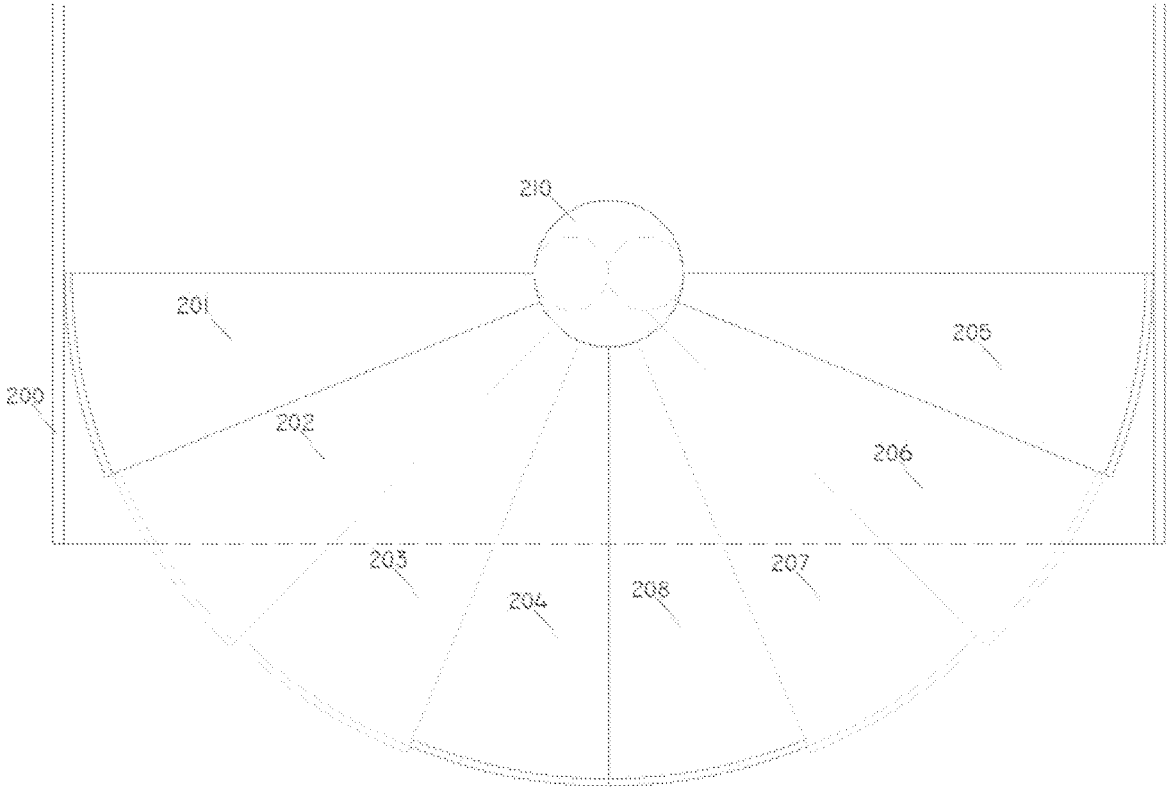

At the sealing mode of the TDM, the slice dome gates 201-208 will be able to be rotated by the gearboxes 210 and 211 and positioned as shown at FIG. 25*c* that will be covering entire face of the TDM. Each of the slice domegates 201-208 will have some overlap with their neighbours. (Have not been shown for clarity). Sealing items (e.g. gaskets) can be added at the mentioned overlaps to provide waterproofing.

Figure 26A:
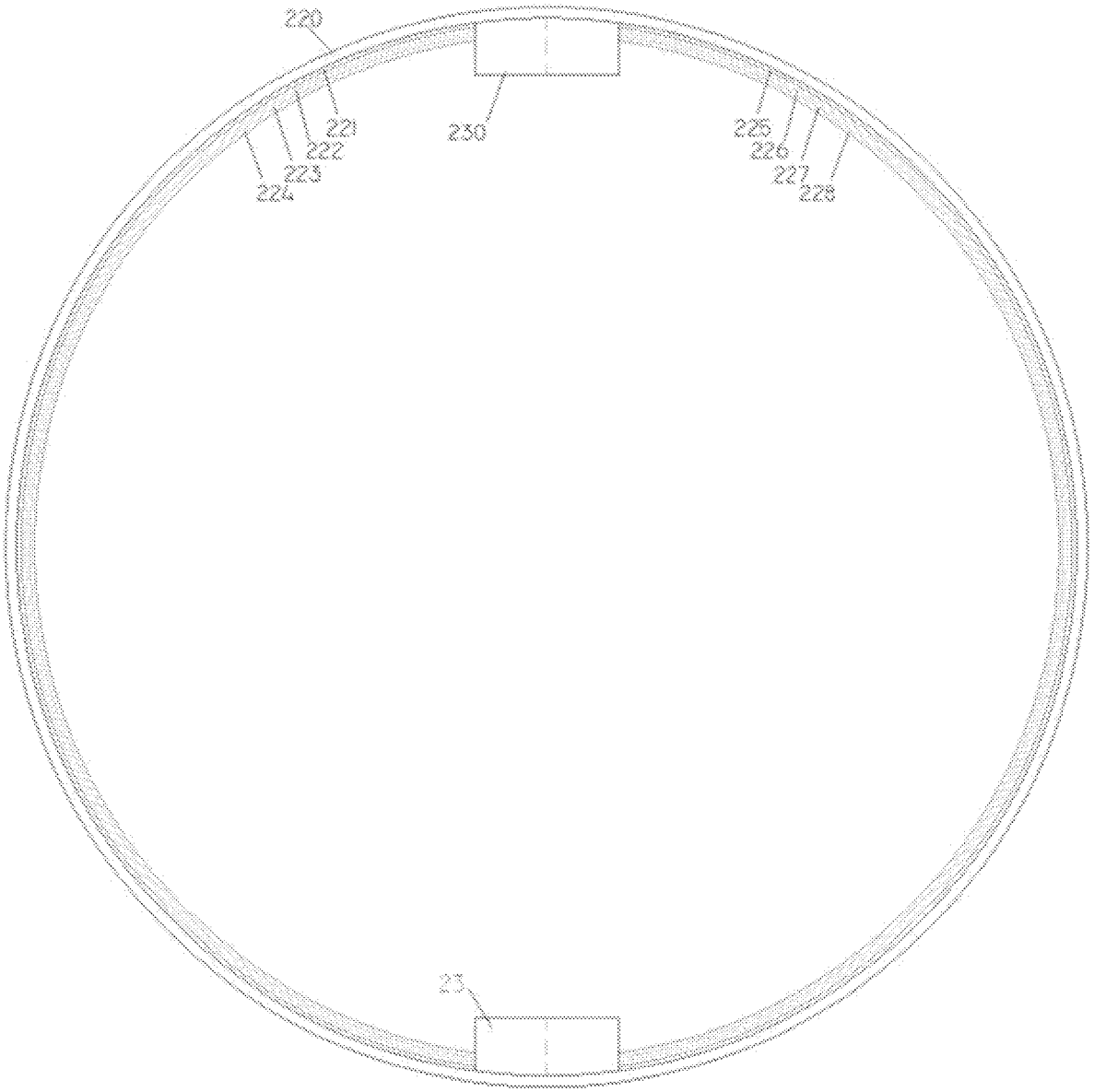
Figure 26B:
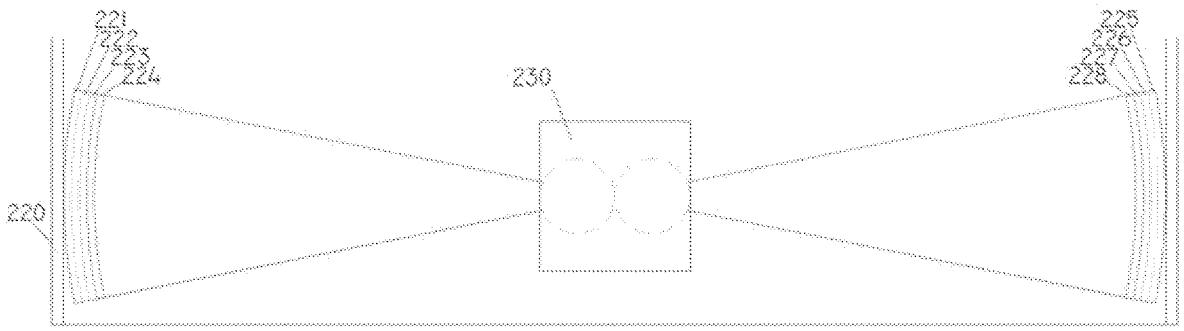
Figure 26C:
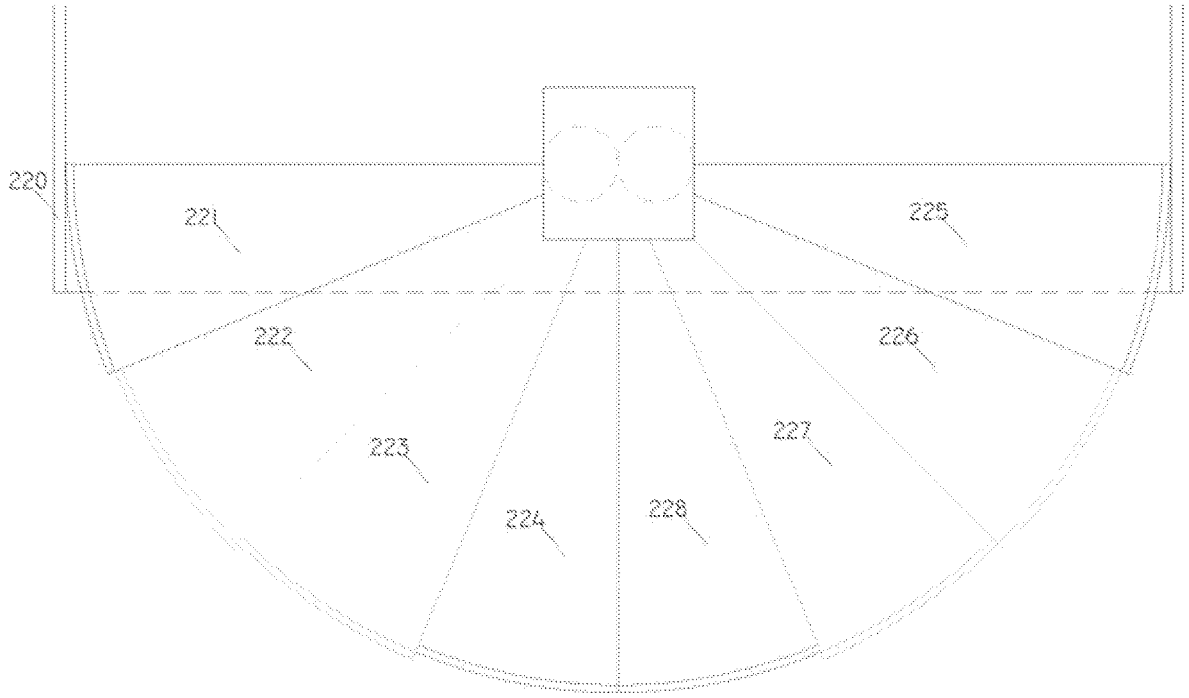

The dome gate sealing method may be adopted with circular TDM or TBM as well as shown at FIGS. 26*a*, 26*b* and 26*c*. Similarly dome gates slice 221-228 will be rotated by gearboxes 230 and 231 to make full face coverage and sealing at the sealing mode of the TDM/TBM.

Optionally slice dome gates 201-208 may be located within cutterhead 220 of the TBM and can be rotated along with the TBM's cutter head 220. At this case cutterhead 220 can be rotated while domegates are being rotated concurrently which will help pushing the slice domegates 221-228 into the un-excavated materials at front of the TBM. Optionally bits/discs may be added to the front edge of the dome gates 221-228 to make them part of the cutting head during digging operation.

Indeed position of the cutter disks/bits which are placed front of the slice domegates 221-228 at perimeter of the cutter head 220 at the digging mode of TBM/TDM should be adjustable (retractable) to provide open face at perimeter of the cutter head 200 which slice domegates 221-228 need to be rotated out of the cutter head 220 at sealing mode.

Elements List

| | |
|---|---|
| 5 | TDM's forward shield |
| 6 | TDM's stationary shield |
| 7 | TDM's tail shield |
| 10 | TDM's Exterior crown |
| 11 | TDM's Exterior wall |
| 12 | TDM's Exterior wall (opposite to 11) |
| 13 | TDM's Exterior base |
| 14 | Internal skin wall |
| 15 | Internal middle thrust frame |
| 16 | Internal rear thrust frame |
| 17 | Internal front thrust frame |
| 21 | Rotor #1 |
| 22 | Rotor #2 |
| 24 | Shutter thrust cylinder |
| 25 | Shutter thrust cylinder-at both ends of shutters |
| 26 | Upper cutter drum |
| 28 | mucking conveyor |
| 29 | Rotor motor #1 |
| 30 | Rotor motor #2 |
| 32 | Shaft sleeve of Rotor #1 |
| 33 | Shaft sleeve of Rotor #2 |
| 34 | Cutting blade of 21 |
| 35 | Cutting blade of 22 |
| 36 | Telescopic extension of 26 |
| 37 | Extendable part of 26 |
| 38 | Screw conveyers helical extension |
| 39 | Foldable discharge ramp #1 of 28 |
| 40 | Foldable discharge ramp #2 of 28 |
| 41 | Conveyor belt #1 |
| 42 | Conveyor belt #2 |
| 45 | Articulation overlap between 5 and 6 |
| 46 | Sealing of 45 |
| 47 | Articulation overlap between 6 and 7 |
| 48 | Sealing of 47 |
| 50 | Mobile frame |
| 51 | Front part of 50 |
| 52 | Upper part of 50 |
| 53 | Horizontal inner upper part of 50 |
| 54 | Horizontal inner lower part of 50 |
| 55 | Lower part of 50 |
| 56 | Side of 50-near Rotor #1 |
| 57 | Side of 50-near Rotor #2 |
| 58 | Vertical inner part of 50-near Rotor #1 |
| 59 | Vertical inner part of 50-near Rotor #2 |
| 61 | TDM/TBM thrust cylinder |
| 62 | Thrust cylinder of 50 |
| 63 | Conventional precast Segment |
| 64 | Helical precast segments |
| 65 | Sealing gasket of 50 |
| 66 | Bottom roller of 50 |
| 67 | Top roller of 50 |
| 70 | Lower cutter drum #1 |
| 71 | Telescopic extension of 70 |
| 72 | Expandable part of 70 |
| 73 | Lower cutter drum #2 |

-continued

| Elements List | |
|---|---|
| 74 | Telescopic extension of 73 |
| 75 | Expandable part of 73 |
| 80 | Sealing shutter gate |
| 81 | Shutter-at straight line |
| 82 | Shutter-at curve line |
| 83 | End Shutter at side 11 |
| 84 | End Shutter at side 12 |
| 85 | Shutter hinge connection |
| 88 | Omega shape protection layer |
| 90 | Main Guide rail |
| 91 | Roller of shutter |
| 92 | Upper bracket of shutter |
| 93 | Secondary guide rail |
| 94 | Lower bracket of shutter |
| 95 | Wheel under 94 |
| 100 | Regular sealing gasket (used at straight lines) |
| 101 | Helical sealing gasket (used at curve) |
| 102 | Sealing gasket on at end shutters 83/84 |
| 103 | Omega sealing |
| 105 | Inflatable seal on 11/12 |
| 106 | Inflatable seal on 10/13 |
| 107 | sealing pad on shutter ends |
| 108 | sealing pad on shutter's front surface |
| 110 | Maintenance chamber/room |
| 121 | Rotating axle of 26 |
| 122 | Motor of 26 |
| 123 | cylinder of 26 |
| 124 | Shaft of 26 |
| 125 | Motor of 70 |
| 126 | cylinder of 70 |
| 127 | Rotating axle of 70 |
| 128 | Shaft of 70 |
| 130 | Injection gate/valve |
| 131 | Discharge gate/valve |
| 135 | Motor of 73 |
| 136 | cylinder of 73 |
| 137 | Rotating axle of 73 |
| 138 | Shaft of 73 |
| 140 | Support of 28 |
| 141 | Protection over 106 |
| 151 | Dowel opening of 63 |
| 152 | Helical gasket |
| 153 | Spacer for the curves |
| 154 | Dowel |
| 165 | Segment Erector #1 |
| 166 | Segment Erector #2 |
| 167 | Muck box roat #1 |
| 168 | Muck box roat #2 |
| 169 | Vent pipe |
| 170 | Column |
| 180 | TDM's brush |
| 182 | Cone supports around 32/33 |
| 185 | Drum gasket |
| 200 | Forward shield of semi-horseshoe TDM |
| 201-208 | Slice dome gates |
| 210 | Upper gearbox |
| 211 | Lower gearbox |
| 220 | Cutter head of TBM |
| 221-228 | Slice dome gates of TBM |
| 230 | Upper gearbox of TBM |
| 231 | Lower gearbox of TBM |

What is claimed is:

1. A tunnel digging machine (TDM) for use in excavation of tunnels, the machine comprising:

a mobile frame that moves back and forth inside a shield of said TDM by a plurality of thrust cylinders, a plurality of cutter rotors, cutter drums and mucking conveyors that are mounted on said mobile frame, wherein in a digging mode of said TDM, said cutter rotors, cutter drums and mucking conveyors are moved forward by expanding said thrust cylinders to reach a face of the tunnel, wherein in a sealing mode of said TDM, said cutter rotors, cutter drums and mucking conveyors are moved backward by retracting said thrust cylinders to a position inside said shield, wherein a plurality of access doors and openings are placed on said mobile frame to make access to a front of said mobile frame for inspection and maintenance purposes in the sealing mode.

2. The tunnel digging machine according to claim 1, further comprising a sealing shutter gate, wherein a plurality of shutters that are connected by hinges and are located between said shield and said mobile frame in the digging mode of said TDM, wherein said shutters are following guide rails on said shield to guide said shutters to turn to a front face of said TDM, wherein said shutters are pushed by shutter cylinders to seal the front face of said TDM in the sealing mode, wherein said shutters are pulled by shutter cylinders to open the front face of said TDM in the digging mode.

3. The tunnel digging machine according to claim 2, further comprising a sealing gasket or U-shape sealing on said shutters contacting faces to waterproof the gap between said shutters.

4. The tunnel digging machine according to claim 2, further comprising an inflatable sealing located on the internal face of said shield to waterproof a gap between shutters and said shield in the sealing mode of said TDM.

5. The tunnel digging machine according to claim 1, further comprising a plurality of rollers mounted on said mobile frame to ease backward and forward movement of said frame inside of said shield.

6. The tunnel digging machine according to claim 1, further comprising sealing gaskets at all external perimeter of said mobile frame to waterproof a gap between said mobile frame and an internal face of said shield.

7. The tunnel digging machine according to claim 1, further comprising a telescopic extension on said cutter drums or blades of said cutter rotors to be retracted in the sealing mode.

8. The tunnel digging machine according to claim 1, further comprising doubled segment erectors to increase speed of a segment installation process.

9. The tunnel digging machine according to claim 1, further comprising a lining system to be used in tunnels to make curves and to waterproof gaps between segments of the lining, the lining system comprising:

a plurality of spacers between circumferential sides of said segments at a curve location of the tunnel, a continuous helical gasket at circumferential sides of said segments to seal the gap between circumferential sides of said segments, a plurality of dowels at circumferential sides of said segments to connect circumferential faces of said segments, wherein said spacers have openings at a location of said dowels.

10. The tunnel digging machine according to claim 9, further comprising bolt connections, interlock or dowels to connect radial sides of said segments.

11. The tunnel digging machine according to claim 1, further comprising a sealing dome gate system to be used for sealing, the system comprising:

a plurality of slice dome gates that are matching with said TDM's interior shape and connected to a gear box mounted on said TDM at both ends of said slice dome gate, wherein said slice dome gates are rotated by said gearboxes, wherein a rotating radius of each said slice dome shape gate is more than its neighboring slice dome gate to be rotated inside each other at digging mode of said TDM, wherein each said slice gate dome is rotated out of said neighboring slice gate to cover a face of said TDM in the sealing mode.

12. The tunnel digging machine according to claim 11, further comprising a plurality of bits or cutting discs at a front edge of said slice dome gates.

* * * * *